US007096945B2

(12) United States Patent
Richards et al.

(10) Patent No.: US 7,096,945 B2
(45) **Date of Patent: *Aug. 29, 2006**

(54) SAND CONTROL SCREEN ASSEMBLY AND TREATMENT METHOD USING THE SAME

(75) Inventors: William Mark Richards, Frisco, TX (US); Travis T. Hailey, Jr., Sugar Land, TX (US); Thomas O. Roane, Corinth, TX (US); Ralph H. Echols, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/424,425

(22) Filed: Apr. 25, 2003

(65) Prior Publication Data

US 2004/0020832 A1 Feb. 5, 2004

Related U.S. Application Data

(63) Continuation-in-part of application No. 10/057,042, filed on Jan. 25, 2002, now Pat. No. 6,719,051, and a continuation-in-part of application No. 10/293,721, filed on Nov. 13, 2002.

(51) Int. Cl.
*E21B 43/04* (2006.01)

(52) U.S. Cl. ..... 166/276; 166/218; 166/236; 166/51

(58) Field of Classification Search ..... 166/276, 166/278, 280.1, 308.1, 227, 228, 236, 51
See application file for complete search history.

(56) References Cited

U.S. PATENT DOCUMENTS 1,975,162 A 10/1934 Layne
2,342,913 A 2/1944 Williams et al.

(Continued)

FOREIGN PATENT DOCUMENTS

EP 0 431 162 6/1991

(Continued)

OTHER PUBLICATIONS

U.S. Appl. No. 10/252,621, Brezinski et al.
"OSCA Screen Communication System", 1 page, Technical Bulletin.
"OSCA Pressure Actuated Circulating Valve", 1 page, Technical Bulletin.

(Continued)

*Primary Examiner*—William Neuder
(74) *Attorney, Agent, or Firm*—Lawrence R. Youst

(57) ABSTRACT

A sand control screen assembly (200) positionable within a production interval of a wellbore that traverses a subterranean hydrocarbon bearing formation comprises a base pipe (202) having openings (204) in a sidewall section thereof that allow fluid flow therethrough. A filter medium (210) is positioned about the exterior of at least a portion of the base pipe (202). The filter medium (210) selectively allows fluid flow therethrough but prevents the flow of particulate of a predetermined size therethrough. A seal member (218, 220, 222) is operably associated with the base pipe (202). The seal member (218, 220, 222) has a one-way valve configuration and a valve open configuration such that the seal member (218, 220, 222) controls fluid flow through the openings (204) of the base pipe (202).

45 Claims, 22 Drawing Sheets

U.S. PATENT DOCUMENTS

| | | | |
|---|---|---|---|
| 2,344,909 | A | 3/1944 | Williams et al. |
| 3,005,507 | A | 10/1961 | Clark Jr. et al. |
| 3,486,558 | A | 12/1969 | Maxwell |
| 3,627,046 | A | 12/1971 | Miller et al. |
| 3,865,188 | A | 2/1975 | Doggett et al. |
| 4,418,754 | A | 12/1983 | Stepp |
| 4,428,428 | A | 1/1984 | Smyrl et al. |
| 4,494,608 | A | 1/1985 | Williams et al. |
| 4,553,595 | A | 11/1985 | Huang et al. |
| 4,558,742 | A | 12/1985 | Huang et al. |
| 4,627,488 | A | 12/1986 | Szarka |
| 4,646,839 | A | 3/1987 | Rickey |
| 4,858,690 | A | 8/1989 | Rebardi et al. |
| 4,886,432 | A | 12/1989 | Kimberlin |
| 4,932,474 | A | 6/1990 | Schroeder, Jr. et al. |
| 4,945,991 | A | 8/1990 | Jones |
| 5,082,052 | A | 1/1992 | Jones et al. |
| 5,113,935 | A | 5/1992 | Jones et al. |
| 5,161,613 | A | 11/1992 | Jones |
| 5,161,618 | A | 11/1992 | Jones et al. |
| 5,228,526 | A | 7/1993 | Vshivkov et al. |
| 5,332,039 | A | 7/1994 | Primeaux et al. |
| 5,333,688 | A | 8/1994 | Jones et al. |
| 5,343,949 | A | 9/1994 | Ross et al. |
| 5,355,953 | A | 10/1994 | Shy et al. |
| 5,355,956 | A | 10/1994 | Restarick |
| 5,386,874 | A | 2/1995 | Laramay et al. |
| 5,390,966 | A | 2/1995 | Cox et al. |
| 5,419,394 | A | 5/1995 | Jones |
| 5,435,393 | A | 7/1995 | Brekke et al. |
| 5,443,117 | A | 8/1995 | Ross |
| 5,476,143 | A | 12/1995 | Sparlin et al. |
| 5,515,915 | A | 5/1996 | Jones et al. |
| 5,588,487 | A | 12/1996 | Bryant |
| 5,636,691 | A | 6/1997 | Hendrickson et al. |
| 5,676,208 | A | 10/1997 | Finley |
| 5,699,860 | A | 12/1997 | Grundmann |
| 5,722,490 | A | 3/1998 | Ebinger |
| 5,730,223 | A | 3/1998 | Restarick |
| 5,755,286 | A | 5/1998 | Ebinger |
| 5,842,516 | A | 12/1998 | Jones |
| 5,848,645 | A | 12/1998 | Jones |
| 5,865,251 | A | 2/1999 | Rebardi et al. |
| 5,868,200 | A | 2/1999 | Bryant et al. |
| 5,890,533 | A | 4/1999 | Jones |
| 5,896,928 | A | 4/1999 | Coon |
| 5,906,238 | A | 5/1999 | Carmody et al. |
| 5,921,318 | A | 7/1999 | Ross |
| 5,934,376 | A | 8/1999 | Nguyen et al. |
| 5,988,285 | A | 11/1999 | Tucket et al. |
| 6,003,600 | A | 12/1999 | Nguyen et al. |
| 6,047,773 | A | 4/2000 | Zeltmann et al. |
| 6,059,032 | A | 5/2000 | Jones |
| 6,112,815 | A | 9/2000 | B.o slashed.e et al. |
| 6,112,817 | A | 9/2000 | Voll et al. |
| 6,116,343 | A | 9/2000 | Van Petegem et al. |
| 6,125,933 | A | 10/2000 | Ross |
| 6,220,345 | B1 | 4/2001 | Jones et al. |
| 6,227,303 | B1 | 5/2001 | Jones |
| 6,230,803 | B1 | 5/2001 | Morton et al. |
| 6,286,594 | B1 | 9/2001 | French |
| 6,302,208 | B1 | 10/2001 | Walker et al. |
| 6,325,150 | B1 | 12/2001 | Rayssiguier |
| 6,343,651 | B1 | 2/2002 | Bixerman |
| 6,371,210 | B1 | 4/2002 | Bode et al. |
| 6,397,950 | B1 | 6/2002 | Streich et al. |
| 6,446,729 | B1 | 9/2002 | Bixenman et al. |
| 6,450,263 | B1 | 9/2002 | Schwendemann |
| 6,457,518 | B1 | 10/2002 | Castano-Mears et al. |
| 6,464,007 | B1 | 10/2002 | Jones |
| 6,478,091 | B1 | 11/2002 | Gano |
| 6,488,082 | B1 | 12/2002 | Echols et al. |
| 6,494,261 | B1 | 12/2002 | Pahmiyer |
| 6,540,022 | B1 | 4/2003 | Dusterhoft et al. |
| 6,543,538 | B1 | 4/2003 | Tolman et al. |
| 6,547,011 | B1 | 4/2003 | Kilgore |
| 6,557,634 | B1 | 5/2003 | Hailey, Jr. et al. |
| 6,622,794 | B1 | 9/2003 | Zisk, Jr. |
| 6,644,412 | B1 | 11/2003 | Bode et al. |
| 6,681,854 | B1 | 1/2004 | Danos |
| 6,695,054 | B1 | 2/2004 | Johnson et al. |
| 6,719,051 | B1 * | 4/2004 | Hailey et al. ..... 166/278 |
| 6,786,285 | B1 | 9/2004 | Johnson et al. |
| 6,857,476 | B1 | 2/2005 | Richards |
| 6,886,634 | B1 | 5/2005 | Richards |
| 6,899,176 | B1 | 5/2005 | Hailey, Jr. et al. |
| 2002/0074119 | A1 | 6/2002 | Bixenman et al. |
| 2002/0092649 | A1 | 7/2002 | Bixenman et al. |
| 2002/0096329 | A1 | 7/2002 | Coon et al. |
| 2002/0125006 | A1 | 9/2002 | Hailey, Jr. et al. |
| 2002/0125008 | A1 | 9/2002 | Wetzel et al. |
| 2002/0157837 | A1 | 10/2002 | Bode et al. |
| 2002/0174981 | A1 | 11/2002 | Den Boer et al. |
| 2002/0189815 | A1 | 12/2002 | Johnson et al. |
| 2003/0000701 | A1 | 1/2003 | Dusterhoft et al. |
| 2003/0000875 | A1 | 1/2003 | Echols et al. |
| 2003/0056947 | A1 | 3/2003 | Cameron |
| 2003/0056948 | A1 | 3/2003 | Cameron |
| 2003/0075324 | A1 | 4/2003 | Dusterhoft et al. |
| 2003/0089496 | A1 | 5/2003 | Price-Smith et al. |
| 2003/0141061 | A1 | 7/2003 | Hailey, Jr. et al. |
| 2003/0141062 | A1 | 7/2003 | Cowan et al. |
| 2003/0188871 | A1 | 10/2003 | Dusterhoft et al. |
| 2004/0020832 | A1 | 2/2004 | Richards et al. |
| 2004/0035578 | A1 | 2/2004 | Ross et al. |
| 2004/0035591 | A1 | 2/2004 | Echols |
| 2004/0173350 | A1 | 9/2004 | Wetzel et al. |

FOREIGN PATENT DOCUMENTS

| | | |
|---|---|---|
| EP | 0 617 195 | 9/1994 |
| EP | 0 955 447 | 11/1999 |
| EP | 1 132 571 A1 | 9/2001 |
| GB | 2371319 A | 1/2002 |
| GB | 2 371 578 | 7/2002 |
| GB | 2 381 021 A | 4/2003 |
| GB | 2 381 811 A | 5/2003 |
| WO | WO 99/12630 | 3/1999 |
| WO | WO 00/61913 | 10/2000 |
| WO | WO 01/14691 | 3/2001 |
| WO | WO 01/42620 | 6/2001 |
| WO | WO 01/44619 | 6/2001 |
| WO | WO 01/49970 | 7/2001 |
| WO | WO 02/10554 A1 | 2/2002 |
| WO | WO 02/055842 A1 | 7/2002 |
| WO | WO 02/057594 A1 | 7/2002 |

OTHER PUBLICATIONS

Restarick, H.L. of Otis Engineering Corp.; "Mechanical Fluid–Loss Control Systems Used During Sand Control Operations"; 1992; pp. 21–36.

"Sand Control Screens"; Halliburton Energy Services, Inc; 1994; 4 pages.

Ebinger, Charles D. of Ely & Associates Inc.; "Frac Pack Technology Still Evolving"; Oil & Gass Journal, Oct. 23, 1995; pp. 60–70.

Hailey, Travis et al. of Halliburton Energy Services, Inc.; "Screenless Single Trip Multizone Sand Control Tool Systems Saves Rig Time"; Society of Petroleum Engineers Inc.; Feb. 2000; pp. 1–11.

"Caps Sand Control Service for Horizontal Completions Improves Gravel Pack Reliability and Increases Production Potential from Horizontal Completions"; Halliburton Energy Services, Inc.; Aug. 2000; 2 pages.
"CAPS Concentric Annular Packing Service for Sand Control"; Halliburton Energy Services Inc.; Aug. 2000; 4 Pages.
Saldungaray, Pedro M. et al. of Schlumberger; "Simultaneous Gravel Packing and Filter Cake Removal in Horizontal Wells Applying Shunt Tubes and Novel Carrier and Breaker Fluid"; Mar. 2001; pp. 1–6.
"QUANTUM Zonal Isolation Tool"; pp. 12–13 of Sand Face Competions Catalog.
"Absolute Isolation System (ASI) Components"; Halliburton Energy Services, Inc.; pp. 5–28 of Downhole Sand Control Components.
"OSCA HPR–ISO System"; Technical Bulletin; 1 page.
"OSCA The ISO System"; Technical Bulletin; 1 page.

* cited by examiner

SAND CONTROL SCREEN ASSEMBLY AND TREATMENT METHOD USING THE SAME

CROSS-REFERENCE TO RELATED PATENT APPLICATIONS

This application is a continuation-in-part application of application Ser. No. 10/057,042 filed Jan. 25, 2002, now U.S. Pat. No. 6,719,051 entitled Sand Control Screen Assembly and Treatment Method Using the Same and a continuation-in-part application of co-pending application Ser. No. 10/293,721 filed Nov. 13, 2002 entitled Sand Control Screen Assembly and Treatment Method Using the Same.

TECHNICAL FIELD OF THE INVENTION

This invention relates, in general, to sand control and fluid loss prevention and, in particular, to a sand control screen assembly having a seal member that prevents fluid loss from the interior to the exterior of the sand control screen assembly following a treatment process performed within a production interval.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It has been found, however, that following a gravel packing operation, the fluid inside the sand control screen tends to leak off into the adjacent formation. This leak off not only results in the loss of the relatively expensive fluid into the formation, but may also result in damage to the gravel pack around the sand control screen and the formation by, for example, fracturing a formation when it is not desirable to fracture that formation. This fluid leak off is particularly problematic in cases where multiple production intervals within a single wellbore require gravel packing as the fluid remains in communication with the various formations for an extended period of time.

In other cases, it may be desirable to perform a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

The fracture fluid must be forced into the formation at a flow rate great enough to fracture the formation allowing the entrained proppants to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid along the entire length of the formation at a high pressure and at a high flow rate.

It has been found, however, that it is difficult to fracture multiple formations traversed by the wellbore that are within a relatively close proximity of one another. This difficulty is the result of the complexity and length of the permanent downhole tools and the associated service tools used to perform the fracture operation. Accordingly, if formations are closer together than the axial length required for the permanent downhole tools and service tool, then certain of the formations cannot be isolated for individual treatment processes.

Therefore, a need has arisen for an apparatus and a treatment method that provide for the treatment of multiple formations that are located relatively close to one another by allowing the use of relatively simple and compact permanent downhole tools and service tools. A need has also arisen for an apparatus and a treatment method that allow for the gravel packing of one or more production intervals while preventing fluid loss into adjacent formations.

SUMMARY OF THE INVENTION

The present invention disclosed herein comprises a sand control screen assembly and method for treating multiple formations traversed by a wellbore. The sand control screen assembly of the present invention provides for the treatment of relatively closely spaced formations by allowing the use of relatively simple and compact permanent downhole tools and service tools. In addition, the sand control screen assembly of the present invention prevents undesirable fluid loss from the interior thereof to an adjacent formation.

The sand control screen assembly comprises a base pipe having a plurality of openings that allow fluid flow therethrough. A filter medium is positioned about the exterior of at least a portion of the base pipe. The filter medium selectively allows fluid flow therethrough and prevents particulate flow of a predetermined size therethrough. A seal member is operably associated with the base pipe. The seal member has a one-way valve configuration and a valve open configuration, thereby controlling the fluid flow through the openings of the base pipe. In the one-way valve configuration, the seal member prevents fluid loss from the interior to the exterior of the sand control screen assembly and allows fluid flow from the exterior to the interior of the sand control screen assembly when the differential pressure between the exterior and the interior of the sand control screen assembly exceeds a predetermined threshold. In the valve open configuration, the seal member allows fluid flow from the interior to the exterior of the sand control screen assembly and from the exterior to the interior of the sand control screen assembly.

In one embodiment, the seal member includes a spring retainer, a biasing member and a shuttle valve. In this embodiment, when the seal member is in the one-way valve configuration, the spring retainer is in a first position relative to the base pipe such that the biasing member urges the shuttle valve into a sealing position. In the first position, the spring retainer may be releasably secured to the base pipe with a plurality of shear pins. When the seal member is in the valve open configuration, the spring retainer is in a second position relative to the base pipe such that the biasing member does not urge the shuttle valve into the sealing position. In the second position, the spring retainer may be secured to the base pipe with a plurality of collet fingers. The spring retainer may be operated from the first position to the second position by the application of a tubing pressure within the base pipe.

When the seal member is in the one-way valve configuration, the shuttle valve has a sealing position and a non sealing position. When the seal member is in the valve open configuration, the shuttle valve has a disabled position. When the shuttle valve is in the disabled position, the shuttle valve may be secured to the base pipe with a keeper ring. The shuttle valve may be operated to the disabled position in response to a differential pressure above a predetermined threshold between the exterior and the interior of the sand control screen assembly. Alternatively, the shuttle valve may be operated to the disabled position by mechanically shifting the shuttle valve relative to the base pipe.

In another aspect of the present invention, a downhole treatment method comprises locating a sand control screen assembly within a production interval of a wellbore, pumping a treatment fluid into the production interval, allowing fluid returns to enter the interior of the sand control screen assembly with a seal member of the sand control screen assembly in a one-way valve configuration, preventing fluid loss from the interior to the exterior of the sand control screen assembly with the seal member in the one-way valve configuration, operating the seal member from the one-way valve configuration to a valve open configuration and allowing production fluids to enter the interior of the sand control screen assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
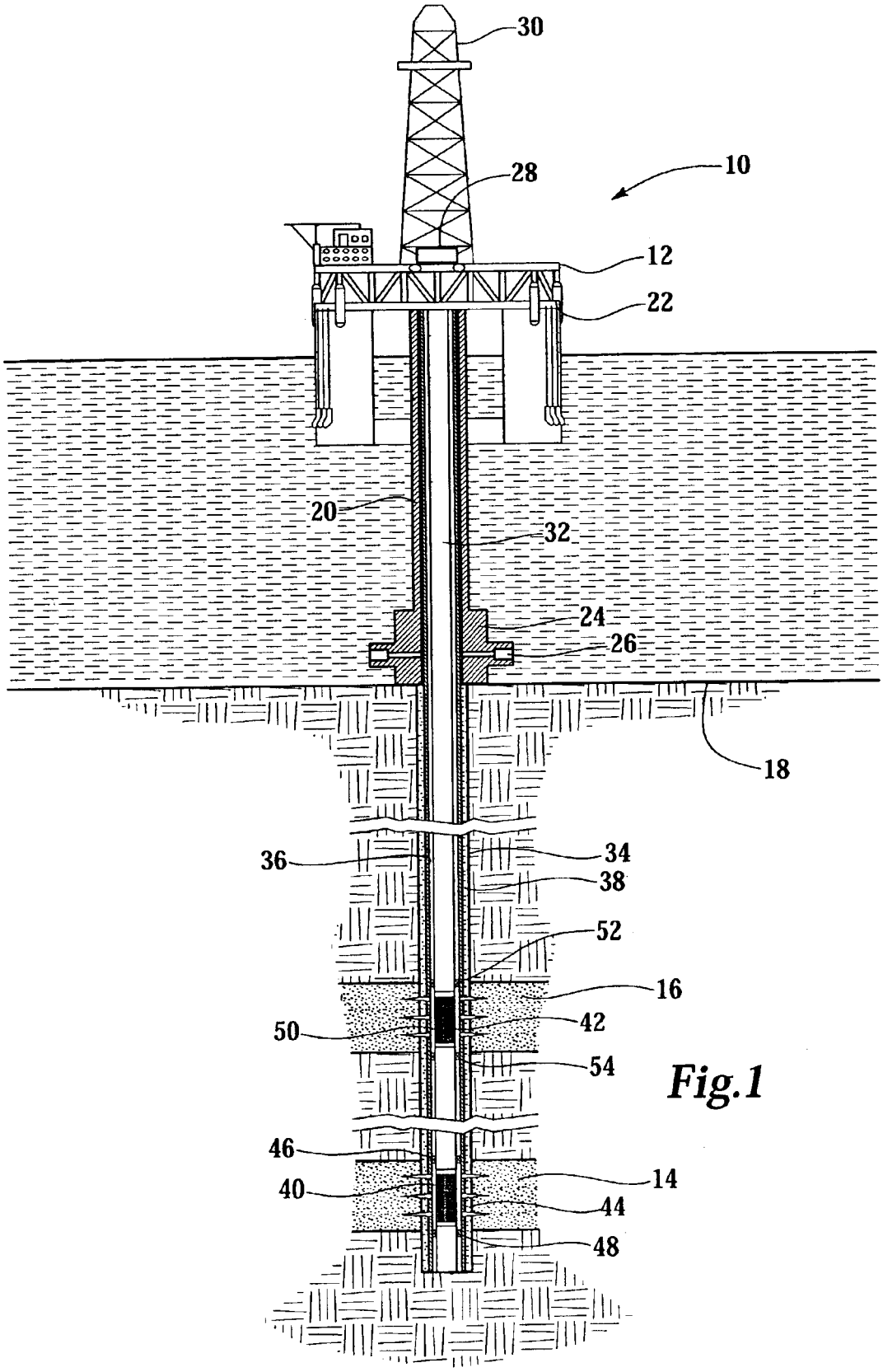
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore in a single trip and operating from an offshore oil and gas platform is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes various tools such as a sand control screen 40 which is positioned within production interval 44 between packers 46, 48 and adjacent to formation 14 and sand control screen 42 which is positioned within production interval 50 between packers 52, 54 and adjacent to formation 16. Thereafter, a treatment fluid containing sand, gravel, proppants or the like is pumped down work string 32 such that formations 14, 16 may be sequentially treated.

Even though FIG. 1 depicts a vertical well, it should be noted by one skilled in the art that the sand control screen assemblies of the present invention are equally well-suited for use in wells having other directional orientations such as deviated wells, inclined wells or horizontal wells. Also, even though FIG. 1 depicts an offshore operation, it should be noted by one skilled in the art that the sand control screen assemblies of the present invention are equally well-suited for use in onshore operations. Also, even though FIG. 1 depicts two formations, it should be understood by one skilled in the art that the treatment processes of the present invention are equally well-suited for use with any number of formations.

Figure 2:
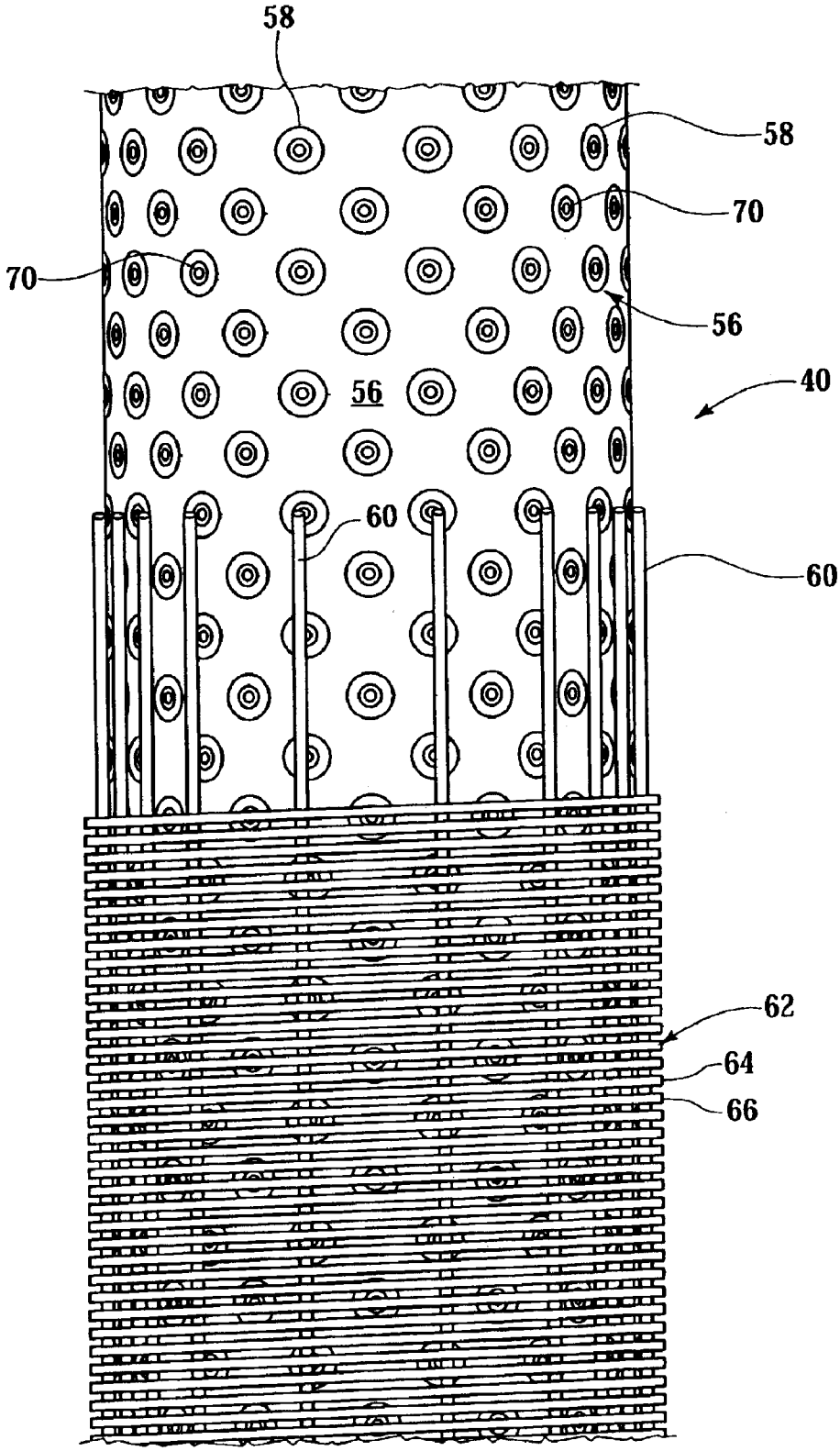
FIG. 2 is a partial cut away view of a sand control screen assembly of the present invention having a seal member disposed within a base pipe.

Referring now to FIG. 2 therein is depicted a more detailed illustration of a sand control screen assembly of the present invention, such as, for example, sand control screen assembly 40 of FIG. 1. Sand control screen assembly 40 includes a base pipe 56 that has a plurality of openings 58 which allow the flow of production fluids into sand control screen assembly 40. The exact number, size and shape of openings 58 are not critical to the present invention, so long as sufficient area is provided for fluid production and the integrity of base pipe 56 is maintained.

Spaced around base pipe 56 is a plurality of ribs 60. Ribs 60 are generally symmetrically distributed about the axis of base pipe 56. Ribs 60 are depicted as having a cylindrical cross section, however, it should be understood by one skilled in the art that ribs 60 may alternatively have a rectangular or triangular cross section or other suitable geometry. Additionally, it should be understood by one skilled in the art that the exact number of ribs 60 will be dependant upon the diameter of base pipe 56 as well as other design characteristics that are well known in the art. Wrapped around ribs 60 is a screen wire 62. Screen wire 62 forms a plurality of turns, such as turn 64 and turn 66. Between each of the turns is a gap through which formation fluids flow. The number of turns and the gap between the turns are determined based upon the characteristics of the formation from which fluid is being produced and the size of the gravel to be used during the gravel packing operation. Together, ribs 60 and screen wire 62 may form a sand control screen jacket which is attached to base pipe 56 by welding or other suitable techniques.

A one-way valve 70 is disposed within each opening 58 of base pipe 56 to prevent fluid flow from the interior to the exterior of the sand control screen assembly 40. One-way valves 70 may be referred to collectively as a seal member 68. Preferably, one-way valves 70 are mounted within openings 58 by threading, stamping or other suitable technique. Ball and seat type one-way valves have been found to be suitable, however, other types of one-way valves may also be used including poppet valves, sleeve valves and the like. One-way valves 70 prevent fluid flow from the interior to the exterior of sand control screen assembly 40 and are actuatable to allow fluid flow from the exterior to the interior of sand control screen assembly 40. Accordingly, when one-way valves 70 are used within base pipe 56 of sand control screen assembly 40 during production, production fluids are allowed to flow through sand control screen assembly 40 through one-way valves 70.

Figure 3A:
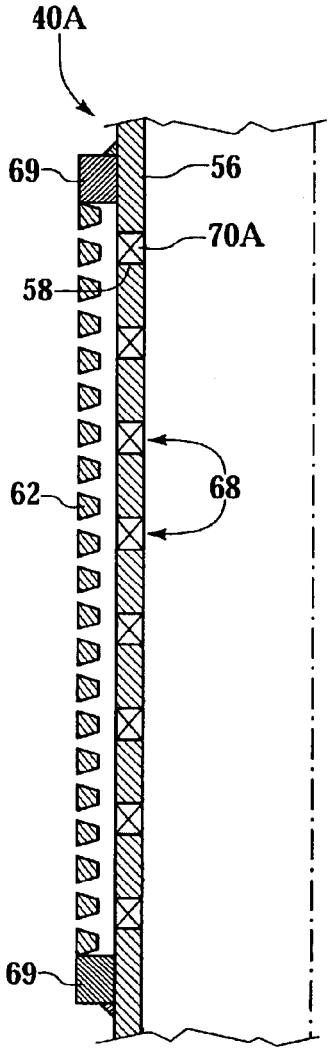
FIGS. 3A–3D are cross sectional views of a sand control screen assembly of the present invention having a seal member comprising a plurality of one-way valves.

Referring now to FIG. 3A, therein is depicted a sand control screen assembly that is generally designated 40A. Sand control screen assembly 40A is substantially identical to sand control screen assembly 40 described above as sand control screen assembly 40A includes base pipe 56 that has a plurality of openings 58, a plurality of ribs (not pictured) and a screen wire 62. Together, the ribs and screen wire 62 form a sand control screen jacket that is attached using connectors 69 to base pipe 56 by welding or other suitable techniques.

One-way valves 70A are disposed within each opening 58 of base pipe 56 to prevent fluid flow from the interior to the exterior of the sand control screen assembly 40A. One-way valves 70A may be referred to collectively as a seal member 68. Preferably, one-way valves 70A are flush mounted within openings 58 by threading, stamping or other suitable technique. One-way valves 70A prevent fluid flow from the interior to the exterior of sand control screen assembly 40A and are actuatable to allow fluid flow from the exterior to the interior of sand control screen assembly 40A. Accordingly, when one-way valves 70A are used within base pipe 56 of sand control screen assembly 40A during production, production fluids are allowed to flow through sand control screen assembly 40A through one-way valves 70A.

Following the downhole treatment precesses discussed in detail below wherein fluid flow from the interior to the exterior of sand control screen assembly 40A is prevented, the ability to flow fluids from the interior to the exterior of sand control screen assembly 40A may be desirable, for example, to perform an acid treatment. Accordingly, one-way valves 70A may be designed to lock out or be rendered inoperable under certain conditions such that one-way valves 70A no longer prevent fluid flow from the interior to the exterior of sand control screen assembly 40A. In such cases, after one-way valves 70A have been operated into the lock out position, fluid flow is allowed from the exterior to the interior and from the interior to the exterior of sand control screen assembly 40A. One method of locking out one-way valves 70A is to expose one-way valves 70A to a differential pressure above a predetermined threshold.

Figure 3B:
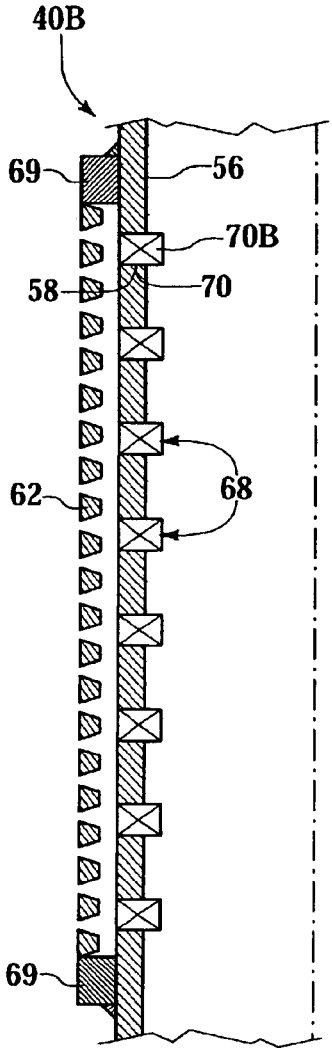

Referring now to FIG. 3B, therein is depicted a sand control screen assembly that is generally designated 40B. Sand control screen assembly 40B is substantially similar to sand control screen assembly 40A described above as sand control screen assembly 40B includes base pipe 56 that has a plurality of openings 58, a plurality of ribs (not pictured) and a screen wire 62. Together, the ribs and screen wire 62 form a sand control screen jacket that is attached using connectors 69 to base pipe 56 by welding or other suitable techniques.

One-way valves 70B are disposed within each opening 58 of base pipe 56 to prevent fluid flow from the interior to the exterior of the sand control screen assembly 40B. One-way valves 70B may be referred to collectively as a seal member 68. Preferably, one-way valves 70B are mounted within openings 58 by threading, stamping or other suitable technique. In the illustrated embodiment, one-way valves 70B extend from openings 58 into base pipe 56. Due to the thickness of the wall of base pipe 56, it may be desirable to use one-way valves 70B that are thicker than the wall of base pipe 56. In this case, it has been found that one-way valves 70B may extend into base pipe 56 and may reduce the inner diameter of base pipe 56 up to thirty percent without having a detrimental impact on the installation or operation of sand control screen assembly 40B during treatment or production. Preferably, one-way valves 70B may reduce the inner diameter of base pipe 56 between about ten and thirty percent.

Figure 3C:
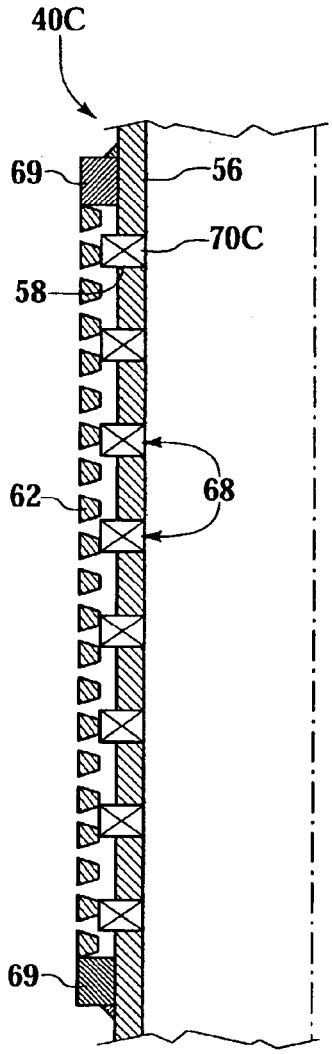

As an alternative and as depicted in FIG. 3C, one-way valves 70C may be disposed within each opening 58 of base pipe 56 to prevent fluid flow from the interior to the exterior of the sand control screen assembly 40C. One-way valves 70C may be referred to collectively as a seal member 68. Preferably, one-way valves 70C are mounted within openings 58 by threading, stamping or other suitable technique. In the illustrated embodiment, one-way valves 70C extend from openings 58 outwardly from base pipe 56 toward screen wire 62. In his embodiment, the ribs (not pictured) must be positioned around base pipe 56 such that openings 58 may receive one-way valves 70C that are thicker than the wall of base pipe 56. In this configuration, base pipe 56 retains its full bore capabilities. Preferably, one-way valves 70C may increase the outer diameter of base pipe 56 between about ten and thirty percent.

Figure 3D:
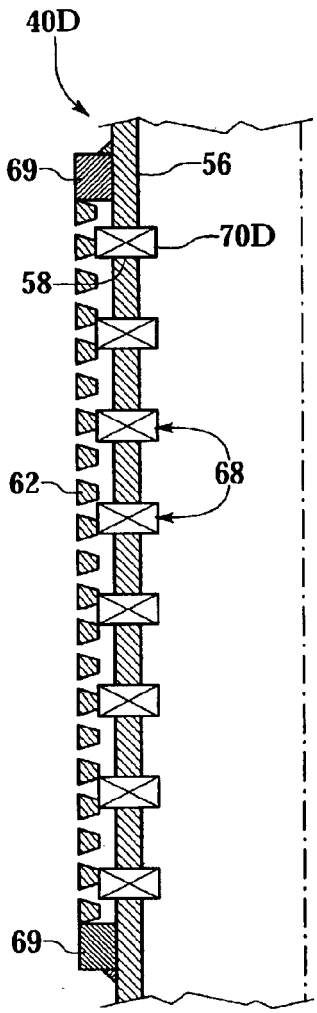

As yet an alternative and as depicted in FIG. 3D, one-way valves 70D may be disposed within each opening 58 of base pipe 56 to prevent fluid flow from the interior to the exterior of the sand control screen assembly 40D. One-way valves 70D may be referred to collectively as a seal member 68. Preferably, one-way valves 70D are mounted within openings 58 by threading, stamping or other suitable technique. In the illustrated embodiment, one-way valves 70D extend inwardly and outwardly from openings 58 of base pipe 56. In his embodiment, the ribs (not pictured) must be positioned around base pipe 56 such that openings 58 may receive one-way valves 70D that are thicker than the wall of base pipe 56. Preferably, one-way valves 70D may increase the outer diameter of base pipe 56 between about ten and thirty percent and may reduce the inner diameter of base pipe 56 between about ten and thirty percent.

Figure 4:
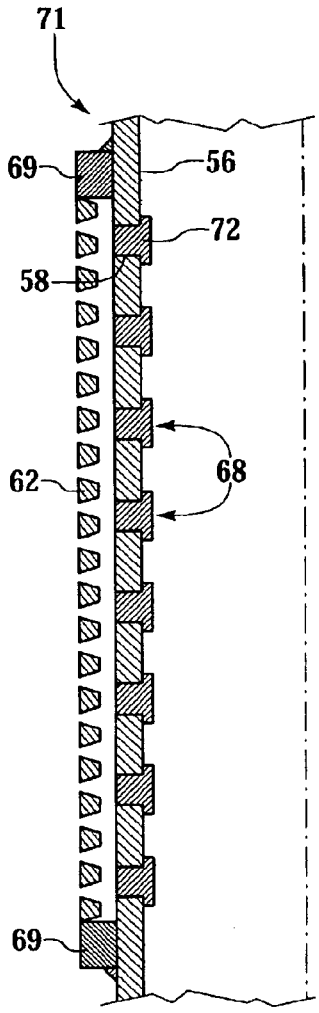
FIG. 4 is a cross sectional view of an alternate embodiment of the sand control screen assembly of the present invention wherein the seal member comprises a plurality of plugs.

Referring now to FIG. 4, therein is depicted an alternative embodiment of a sand control screen assembly that is generally designated 71. Sand control screen assembly 71 includes base pipe 56 having a plurality of openings 58 with screen wire 62 wrapped therearound and attached to base pipe 56 with connectors 69. Disposed within openings 58 of base pipe 56 are a plurality of plugs 72 that prevent fluid flow through openings 58 and serve as seal member 68 in this embodiment. Following the downhole treatment processes discussed in more detail below, plugs 72 are removed from openings 58 such that production fluids may flow to the interior of sand control screen assembly 71.

Plugs 72 may be any conventional plugs known or unknown in the art, including metal plugs, such as aluminum plugs, ceramic plugs or the like. The techniques used to remove plugs 72 will depend upon the construction of plugs 72. If plugs 72 are formed from an acid reactive material such as aluminum, an acid treatment may be used to remove plugs 72. The acid may be pumped into the interior of sand control screen assembly 71 where it will react with the reactive plugs, thereby chemically removing plugs 72.

Alternatively, regardless of the type of plug, plugs 72 may be mechanically removed. For example, a scraping mechanism may be used to physically contact plugs 72 and remove plugs 72 from the openings 58. As another alternative, if plugs 72 are constructed from propellants, a combustion process may be used to remove plugs 72. Likewise, if plugs 72 are constructed from friable materials such as ceramics, a vibration process, such as sonic vibrations may be used to remove plugs 72. As a further alternative, plugs 72 may be removed by applying a preselected amount of differential pressure across plugs 72.

Figure 5:
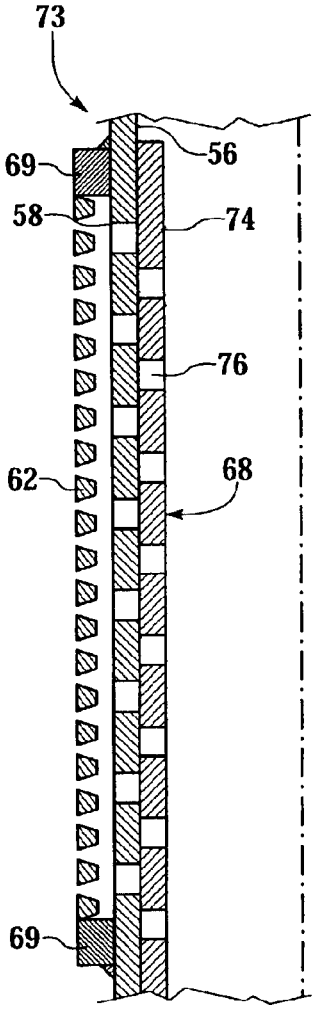
FIG. 5 is a cross sectional view of an alternate embodiment of a sand control screen assembly of the present invention wherein the seal member comprises a sliding sleeve.

Referring now to FIG. 5, an alternative embodiment of a sand control screen assembly is illustrated and generally designated 73. Sand control screen assembly 73 includes base pipe 56 having a plurality of openings 58 with screen wire 62 wrapped therearound. Disposed within base pipe 56 is a sleeve 74 having multiple ports 76 that serves as seal member 68 in this embodiment. When in a first position, ports 76 of sleeve 74 do not align with openings 58 of the base pipe 56. When in a second position, ports 76 of sleeve 74 align with openings 58 of base pipe 56. When sleeve 74 is in the first position, fluid flow from the exterior of sand control screen assembly 73 to the interior of sand control screen assembly 73 is prevented, as is fluid flow from the interior to the exterior of sand control screen assembly 73. When sleeve 74 is in the second position, fluid flow from the exterior of sand control screen assembly 73 to the interior of the sand control screen assembly 73 is allowed, as is fluid flow from the interior to the exterior of sand control screen assembly 73. Sleeve 74 can be displaced between the first position and second position by any conventional means such as axial displacement or rotational displacement. In an alternative embodiment, sleeve 74 can be a removable sleeve in which case ports 76 are not required.

Figure 6A:
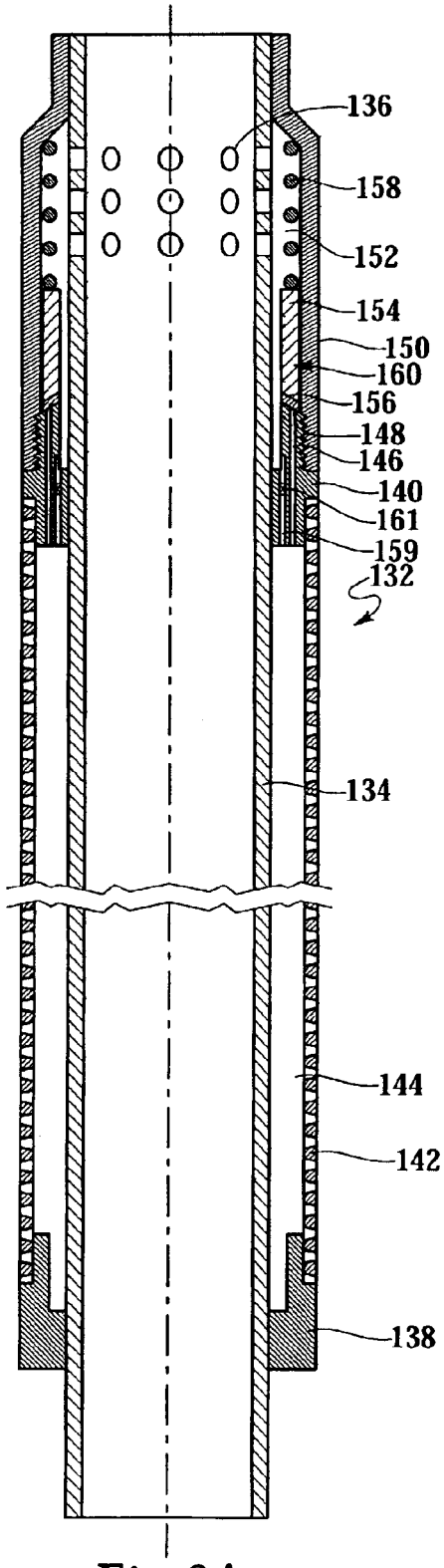
FIGS. 6A–6B are cross sectional views of an alternate embodiment of a sand control screen assembly of the present invention wherein the seal member comprises a sliding sleeve.
Figure 6B:
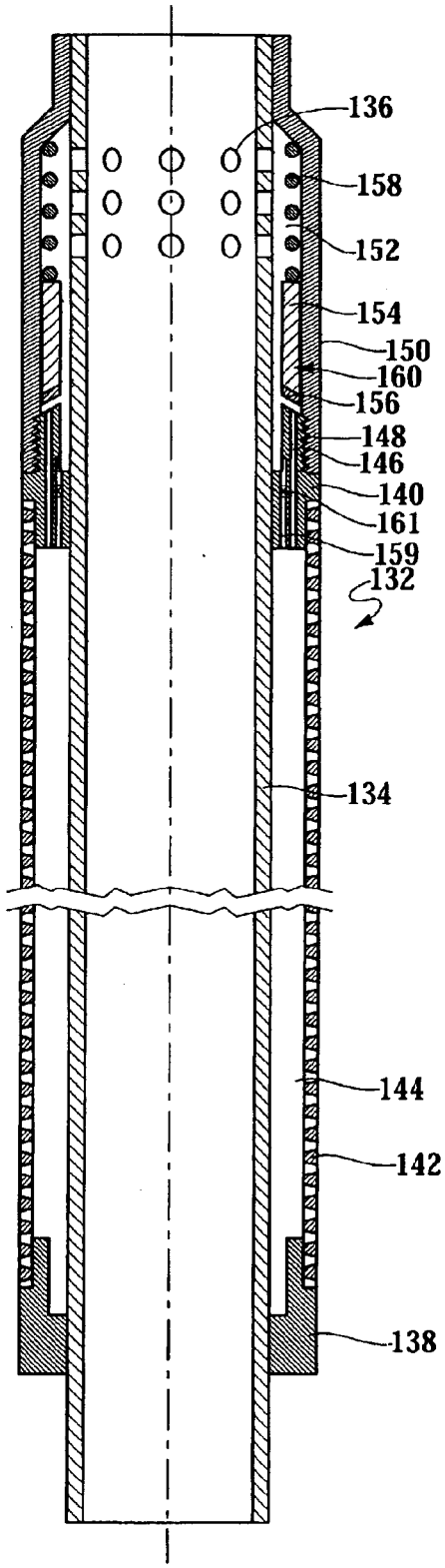

Referring now to FIGS. 6A–6B, therein is depicted another embodiment of a sand control screen assembly of the present invention that is generally designated 132. Sand control screen assembly 132 includes a base pipe 134 that has a non perforated section and a perforated section that includes a series of openings 136 that are circumferentially spaced therearound. Sand control screen assembly 132 has a pair of screen connectors 138, 140 that securably and sealingly attach a sand control screen 142 to base pipe 134. Screen connectors 138, 140 may be attached to base pipe 134 by welding or other suitable technique. Sand control screen 142 may comprise a screen wire wrapped around a plurality of ribs as described above. Sand control screen 142 is disposed around the section of base pipe 134 that is not perforated.

Screen connectors 138, 140 attach sand control screen 142 to base pipe 134 such that an annulus 144 is formed between sand control screen 142 and base pipe 134. It should be noted that centralizers or other support members may be disposed within annulus 144 to support sand control screen 142 and maintain the standoff between sand control screen 142 and base pipe 134. Screen connector 140 includes one or more fluid passageways 146. Screen connector 140 also has an upper sealing surface 148. Securably and sealingly coupled to the upper end of screen connector 140 is a housing member 150. Housing member 150 forms an annulus 152 with base pipe 134 adjacent to openings 136 and is sealingly coupled to base pipe 134 at its upper end. Disposed within annulus 152 is an annular sliding sleeve 154 having a sealing surface 156 which is preferably made from a resilient material such as an elastomer or polymer. Also disposed within annulus 152 is a spiral wound compression spring 158 that downwardly biases sliding sleeve 154.

Together, spring 158, sliding sleeve 154 and screen connector 140 form an annular one-way valve 160 that may be referred to as a seal member. One-way valve 160 prevents fluid flow from the interior to the exterior of sand control screen assembly 132, as best seen in FIG. 6A, and is actuatable to allow fluid flow from the exterior to the interior of sand control screen assembly 132, as best seen in FIG. 6B. For example, during a treatment process as described below wherein a treatment fluid is pumped into the interior of sand control screen assembly 132 and is discharged into the wellbore annulus above sand control screen assembly 132, fluid flow from the interior to the exterior of sand control screen assembly 132 is prevented. Specifically, the bias force of spring 158 and the force created by differential pressure across sliding sleeve 154 between the interior and the exterior of sand control screen assembly 132 both act downwardly on sliding sleeve 154 such that sealing surface 156 sealingly engages sealing surface 148 of screen connector 140, thereby preventing fluid flow from the interior to the exterior of sand control screen assembly 132.

During production, production fluids are allowed to flow from the exterior to the interior of sand control screen assembly 132 through a fluid flow path within sand control screen assembly 132. Specifically, the fluid flows through sand control screen 142, travels along base pipe 134 in annulus 144, passes through fluid passageways 146 in screen connector 140 to unseat sliding sleeve 154 from sealing surface 148 of screen connector 140 by compressing spring 158, then travels around sliding sleeve 154, which may include a fluid bypass (not pictured), in annulus 152 and through openings 136.

Following the downhole treatment precesses discussed below wherein fluid flow from the interior to the exterior of sand control screen assembly 132 is prevented, the ability to flow fluids from the interior to the exterior of sand control screen assembly 132 may be desirable, for example, to perform an acid treatment. Accordingly, one-way valve 160 may be designed to lock out or be rendered inoperable under certain conditions such that one-way valve 160 no longer prevents fluid flow from the interior to the exterior of sand control screen assembly 132. For example, in the illustrated embodiment, when a sufficient differential pressure is placed across sliding sleeve 154 between the interior and the exterior of sand control screen assembly 132, a ceramic disk 161 in bypass passageway 159 may rupture to permanently open bypass passageway 159. In such cases, after one-way valve 160 has been rendered inoperable, fluid flow is allowed from the exterior to the interior and from the interior to the exterior of sand control screen assembly 132.

Figure 7A:
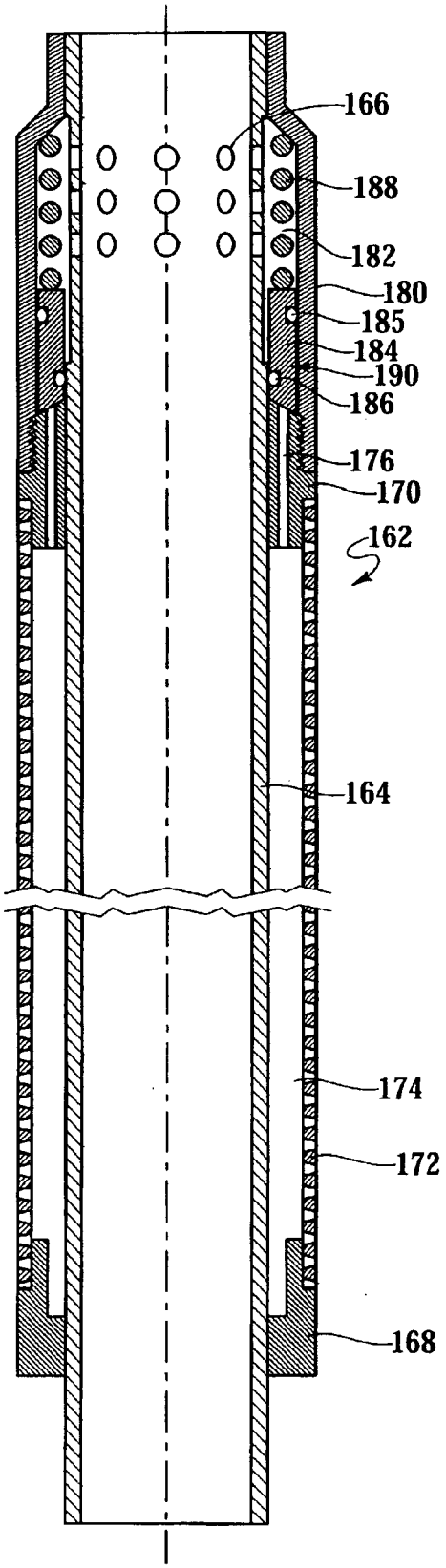
FIGS. 7A–7B are cross sectional views of an alternate embodiment of a sand control screen assembly of the present invention wherein the seal member comprises a sliding sleeve.
Figure 7B:
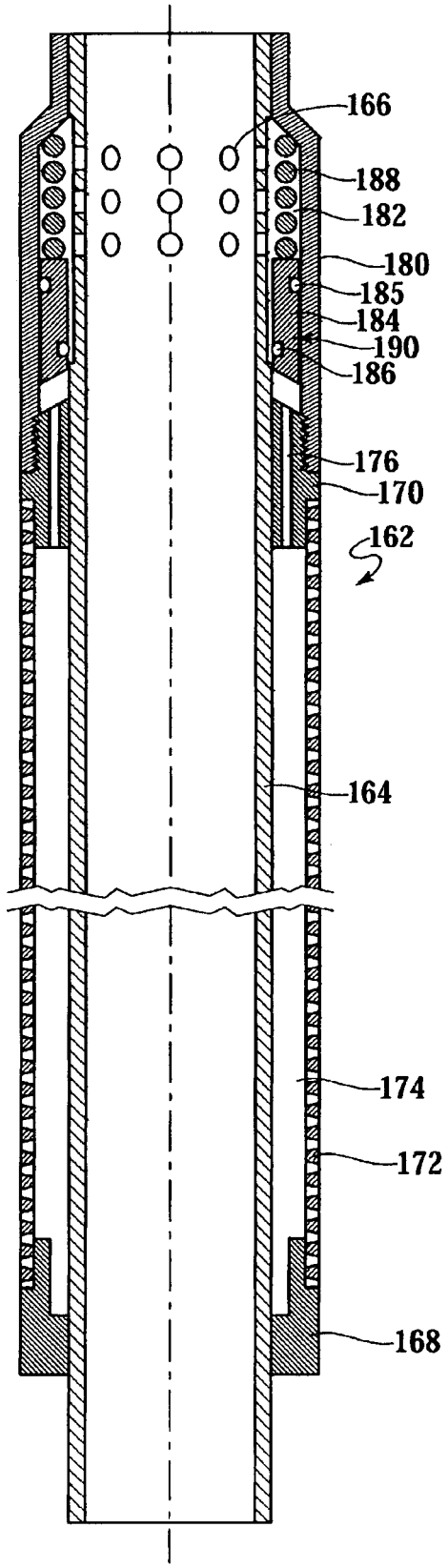

Referring now to FIGS. 7A–7B, therein is depicted another embodiment of a sand control screen assembly of the present invention that is generally designated 162. Sand control screen assembly 162 includes a base pipe 164 that has a non perforated section and a perforated section that includes a series of openings 166 that are circumferentially spaced therearound. Sand control screen assembly 162 has a pair of screen connectors 168, 170 that securably and sealingly attach a sand control screen 172 to base pipe 164. Screen connectors 168, 170 may be attached to base pipe 164 by welding or other suitable technique. Sand control screen 172 may comprise a screen wire wrapped around a plurality of ribs as described above. Sand control screen 172 is disposed around the section of base pipe 164 that is not perforated.

Screen connectors 168, 170 attach sand control screen 172 to base pipe 164 such that an annulus 174 is formed between sand control screen 172 and base pipe 164. Screen connector 170 includes one or more fluid passageways 176. Securably and sealingly coupled to the upper end of screen connector 170 is a housing member 180. Housing member 180 forms an annulus 182 with base pipe 164 adjacent to openings 166 and is sealingly coupled to base pipe 164 at its upper end. Disposed within annulus 182 is an annular sliding sleeve 184. A seal 185 is positioned exteriorly of sliding sleeve 184 to provide a seal against the interior surface of housing member 180. Likewise, a seal 186 is positioned interiorly of sliding sleeve 184 to provide a seal against the exterior surface of base pipe 164. Preferably seals 185, 186 are made from a resilient material such as an elastomer or polymer. Also disposed within annulus 182 is a spiral wound compression spring 188 that downwardly biases sliding sleeve 184.

Together, spring 188, sliding sleeve 184, housing member 180 and base pipe 164 form an annular one-way valve 190 that may be referred to as a seal member. One-way valve 190 prevents fluid flow from the interior to the exterior of sand control screen assembly 162, as best seen in FIG. 7A, and is actuatable to allow fluid flow from the exterior to the interior of sand control screen assembly 162, as best seen in FIG. 7B. Specifically, during a treatment process as described below, a differential pressure force and spring 188 downwardly bias sliding sleeve 184 such that seal 185 is in sealing engagement with the interior surface of housing member 180 and seal 186 is in sealing engagement with the exterior surface of base pipe 164 which prevents fluid flow from the interior to the exterior of sand control screen assembly 162. During production, production fluids are allowed to flow from the exterior to the interior of sand control screen assembly 182 by passing through sand control screen 172, traveling along base pipe 164 in annulus 174, passing through fluid passageways 176 in screen connector 170 to shift sliding sleeve 184 such that seal 186 is out of sealing engagement with base pipe 164 by compressing spring 188, then traveling around sliding sleeve 184 in the radially reduced section of base pipe 164 and through openings 166.

Even though FIGS. 6A–7B have been described as including annular sliding sleeves 154, 184, it should be understood by those skilled in the art that the illustrated sliding sleeves 154, 184 could alternatively represent one or more pistons. For example, sliding sleeves 154, 184 could alternatively be one or more semi-annular pistons that are acted upon simultaneously by a single spiral wound compression spring. As a further example, sliding sleeves 154, 184 could alternatively be one or more rod type pistons each of which could be acted upon by a corresponding spring.

Figure 8:
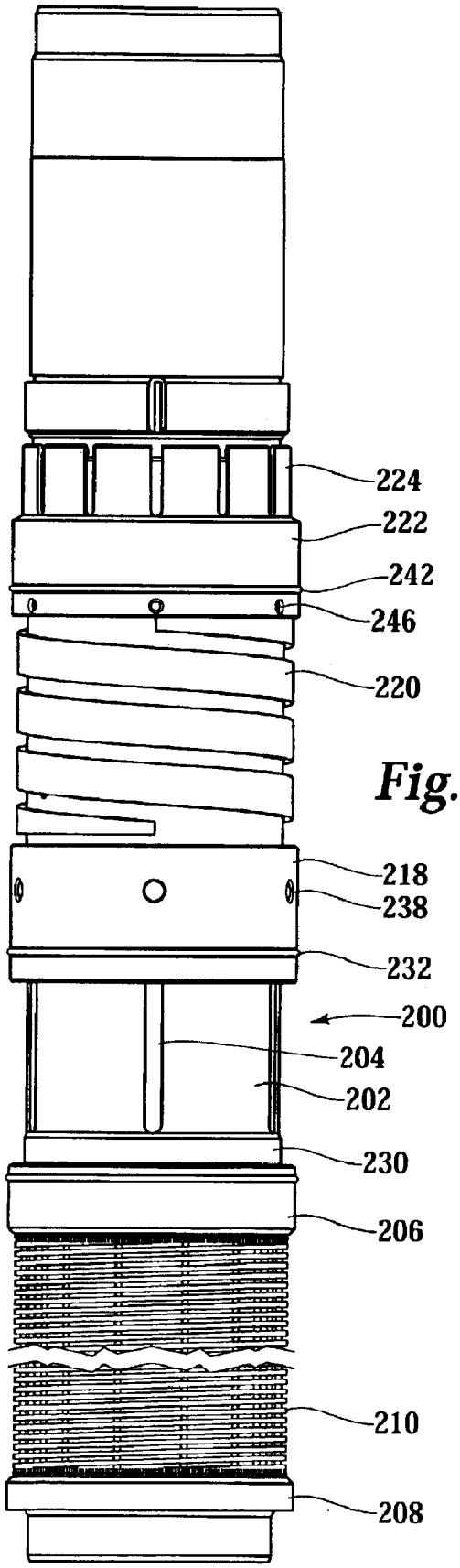
FIG. 8 is a front plan view of the internal structure of an alternate embodiment of a sand control screen assembly of the present invention wherein the seal member comprises a sliding sleeve.
Figure 9A:
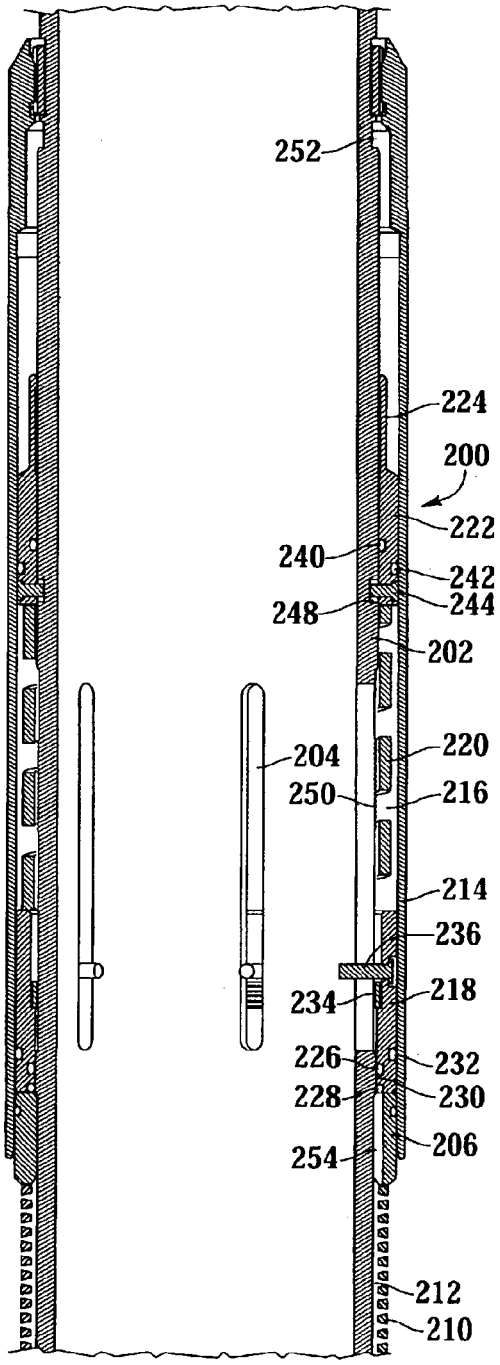
FIGS. 9A–9D are cross sectional views of the embodiment of the sand control screen assembly of FIG. 8 in various positions.
Figure 9B:
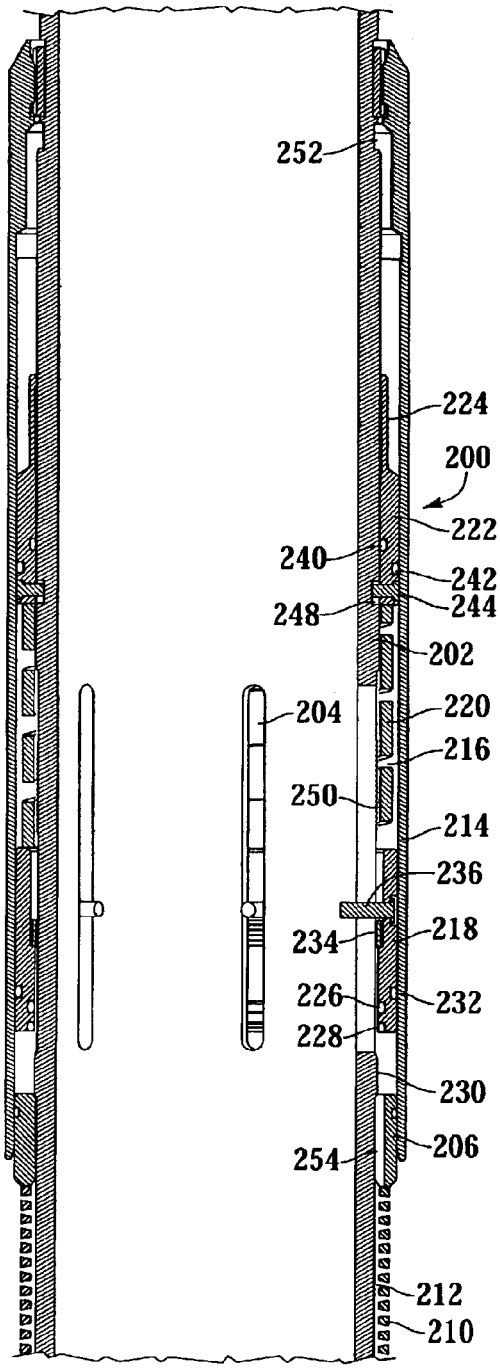
Figure 9C:
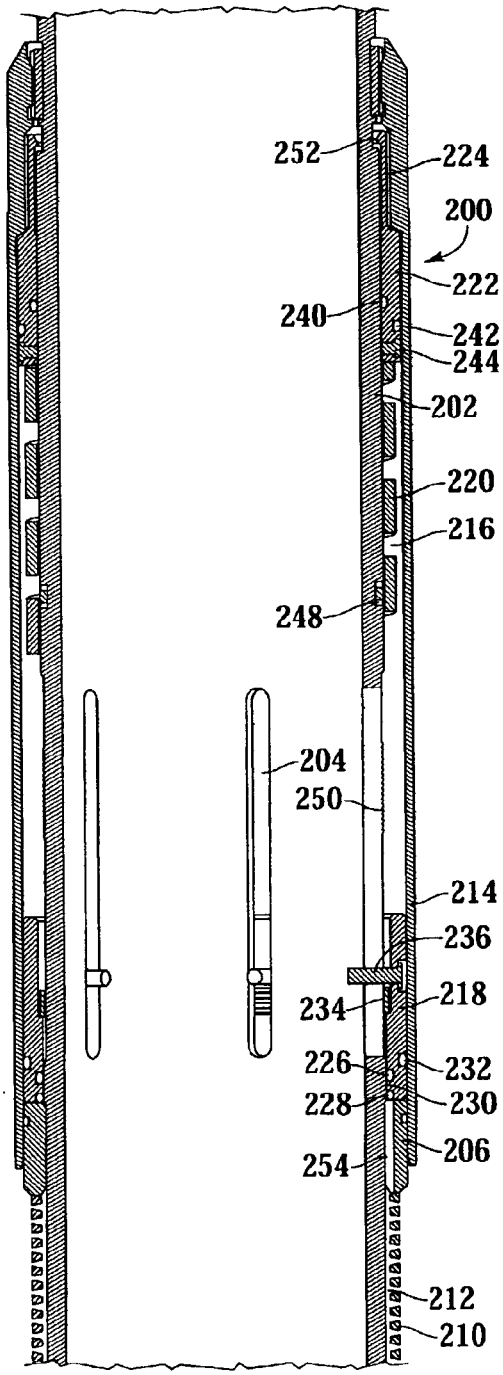
Figure 9D:
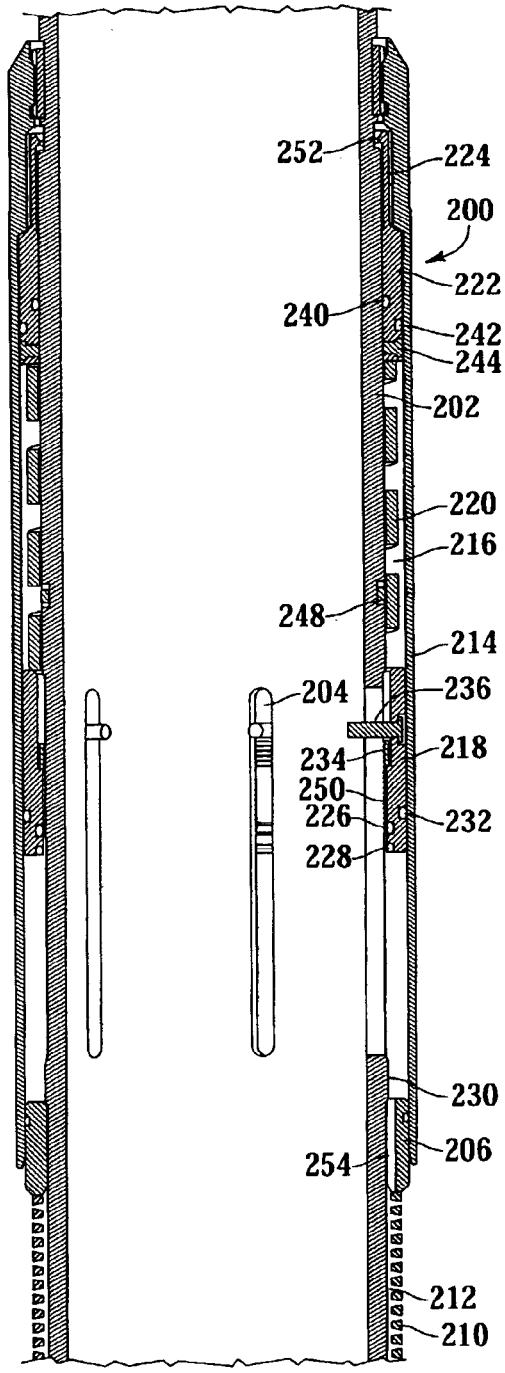

Referring next to FIGS. 8–9D in combination, various positions of another embodiment of a sand control screen assembly of the present invention are depicted with the positioned depicted in FIG. 8 corresponding to the position depicted in FIG. 9D. Sand control screen assembly 200 includes a base pipe 202 that has a series of openings 204 that are depicted as slots that are circumferentially spaced around base pipe 202. Sand control screen assembly 200 has a pair of screen connectors 206, 208 that attach sand control screen 210 to base pipe 202. Screen connectors 206, 208 may be attached to base pipe 202 by welding or other suitable technique. Sand control screen 210 may comprise any type of filter medium such as the depicted wire wrapped screen which allows the flow of formation fluids therethrough but which blocks the flow of particulate matter therethrough.

Screen connectors 206, 208 attach sand control screen 210 to base pipe 202 such that an annulus 212 is formed between sand control screen 210 and base pipe 202. Coupled to screen connector 206 is a housing member 214. Housing member 214 forms an annulus 216 with base pipe 202 adjacent to openings 204. Disposed within annulus 216 is an annular sleeve referred to as shuttle valve 218, a biasing member 220 depicted as a spiral would compression spring and a spring retainer 222 having collet fingers 224. Shuttle valve 218 has a pair of seals 226, 228 positioned on the interior thereof that provide a seal against sealing surface 230 of base pipe 202. Shuttle valve 218 also has a seal 232 positioned on the exterior thereof that provides a seal against the interior of housing member 214.

Positioned between shuttle valve 218 and base pipe 202 is a keeper ring 234. A plurality of pins 236 extend through openings 238 of shuttle valve 218 into slots 204. Spring retainer 222 has a seal 240 positioned on the interior thereof that provide a seal against base pipe 202. Spring retainer 222 also has a seal 242 positioned on the exterior thereof that provides a seal against the interior of housing member 214. A plurality of shear pins 244 extend through openings 246 of spring retainer 222 and initially into a shear pin receiving groove 248 in the exterior surface of base pipe 202. Base pipe 202 also has a mating profile 250 and a collet finger receiving groove 252.

The operation of sand control screen assembly 200 will now be described. FIG. 9A depicts sand control screen assembly 200 in its run-in position. Specifically, spring retainer 222 is secured to base pipe 202 with shear pins 244. This causes spring 220 to downwardly bias shuttle valve 218 against screen connector 206. In this position, a seal is created between shuttle valve 218 and sealing surface 230 of base pipe 202 by seals 226, 228. In addition, a seal is created between shuttle valve 218 and the interior of housing member 214 by seal 232. Once sand control screen assembly 200 is properly positioned downhole adjacent to a production interval, a treatment process such as a gravel pack, frac pack, fracture operation or the like may then take place.

During the treatment operation, returns may be taken through sand control screen assembly 200, as best seen in FIG. 9B. Specifically, spring retainer 222 remains secured to base pipe 202 with shear pins 244 allowing spring 220 to continue to downwardly bias shuttle valve 218. The fluid pressure created by the returns that pass through sand control screen 210, annulus 212 and axially oriented passageways 254 in screen connector 206, however, upwardly biases shuttle valve 218 to unseat shuttle valve 218 allowing the returns to flow through annulus 216 and slots 204 into the interior of base pipe 202 for return to the surface. Once the treatment process is complete, the bias force of spring 220 will return shuttle valve 218 to the sealing position depicted in FIG. 9A. In this position, fluid loss from the interior to the exterior of sand control screen assembly 200 is prevented as a seal is created between shuttle valve 218 and sealing surface 230 of base pipe 202 by seals 226, 228 and a seal is created between shuttle valve 218 and the interior of housing member 214 by seal 232. Accordingly, spring retainer 222, spring 220, shuttle valve 218, housing member 214 and base pipe 202 form an annular one-way valve that may be referred to as a seal member.

When it is desirable to commence production from the interval adjacent to sand control screen assembly 200, sand control screen assembly 200 is operated to its production configuration, as best seen in FIG. 9C. First, a tubing pressure is applied within base pipe 202. This pressure enters annulus 216 via slots 204 to act between spring retainer 222 and shuttle valve 218. When the upwardly acting force on spring retainer 72 is sufficient, shear pins 244 will break which allows spring retainer 222 and spring 220 to move upwardly relative to base pipe 202 until collet fingers 224 engage collet finger receiving groove 252. In this configuration, spring retainer 222 is prevented from further axial movement relative to base pipe 202. In addition, spring 220 no longer applies a downward bias force against shuttle valve 218.

As best seen in FIG. 9D, once the tubing pressure is released, formation pressure acting on shuttle valve 218 will shift shuttle valve 218 axially upward until shuttle valve 218 contacts spring 220 which prevent further upward movement of shuttle valve 218. In addition, as keeper ring 234 has engaged mating profile 250 of base pipe 202, downward movement of shuttle valve 218 is also prevented. In this configuration, production fluid may flow into base pipe 202 through slots 204 uninhibited by shuttle valve 218.

To verify that shuttle valve 218 has moved sufficiently upwardly to allow the free flow of production fluids into base pipe 202 or to overcome any malfunctions of spring retainer 222 or shuttle valve 218, sand control screen assembly 200 is equipped with pins 236 that extend from shuttle valve 218 into the interior of base pipe 202 through slots 214. Pins 236 allow for a redundant mechanical lock out procedure of shuttle valve 218 using a tool that is run downhole on a conveyance such as a wireline. For example, a scraper tool may be run downhole such that it engages pins 236. The scraper tool is then pulled back uphole to operate shuttle valve 218 to the position depicted in FIG. 9D. Alternatively, a sleeve having a profile could be positioned within base pipe 202 and coupled to shuttle valve 218 through slots 214. A tool having the matching profile could then be run downhole to engage the sleeve and operate shuttle valve 218 to the position depicted in FIG. 9D.

It should be understood by those skilled in the art that while FIGS. 2–9D have depicted a wire wrapped sand control screen, other types of filter media could alternatively be used in conjunction with the apparatus of the present invention, including, but not limited to, a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough.

Figure 10:
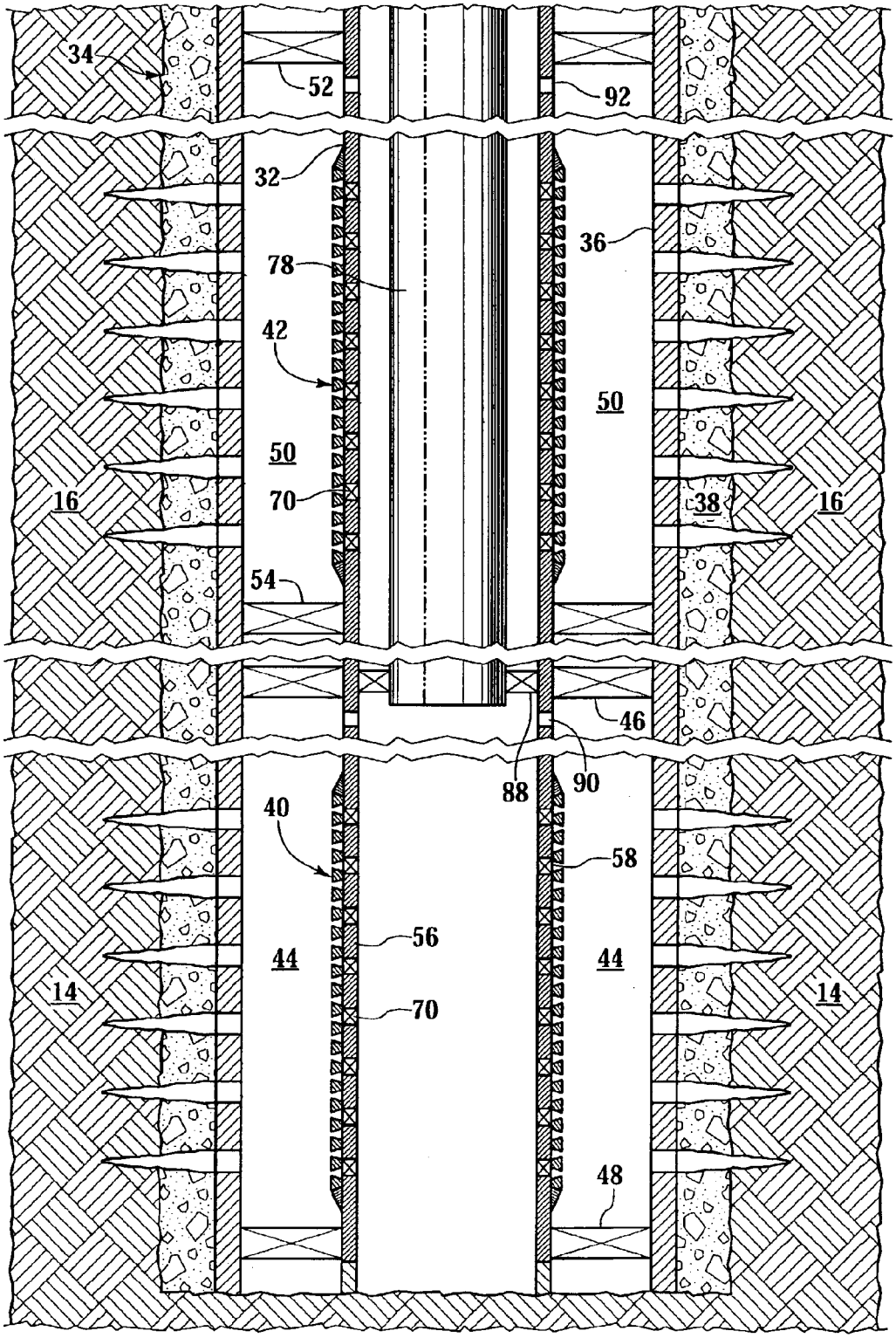
FIG. 10 is a half sectional view of a downhole production environment including a pair of sand control screen assemblies of the present invention before a downhole treatment process.

Referring now to FIG. 10, therein is schematically depicted an embodiment of the present invention that is used during fracturing and frac packing treatments. It should be clearly understood by those skilled in the art that any of the above-described sand control screen assemblies could be used during the treatment processes described below and the use of the particular embodiment depicted in the following figures is for convenience of illustration. As illustrated, sand control screen assembly 40 including one-way valves 70, is positioned within casing 36 and is adjacent to formation 14. Likewise, sand control screen assembly 42 including one-way valves 70, is positioned within casing 36 and is adjacent to formation 16. A service tool 78 is positioned within the work string 32. As illustrated by the break between service tool 78 and sand control screen assemblies 40, service tool 78 may be operably positioned several feet to several hundred feet uphole of sand control screen assembly 40.

To begin the completion process, production interval 44 adjacent to formation 14 is isolated. Packer 46 seals the near end of production interval 44 and packer 48 seals the far end of production interval 44. Likewise, production interval 50 adjacent to formation 16 is isolated. Packer 52 seals the near end of production interval 50 and packer 54 seals the far end of production interval 50. Additionally, seal element 88 is coupled to service tool 78. Seal element 88 contacts the interior of work string 32 forming a seal, thereby preventing fluid flow into the annulus between work string 32 and service tool 78. Work string 32 includes cross-over ports 90, 92 that provide a fluid communication path from the interior of work string 32 to production intervals 44, 50, respectively. Preferably, fluid flow through cross-over ports 90, 92 is controlled by suitable valves that are opened and closed by conventional means.

Figure 11:
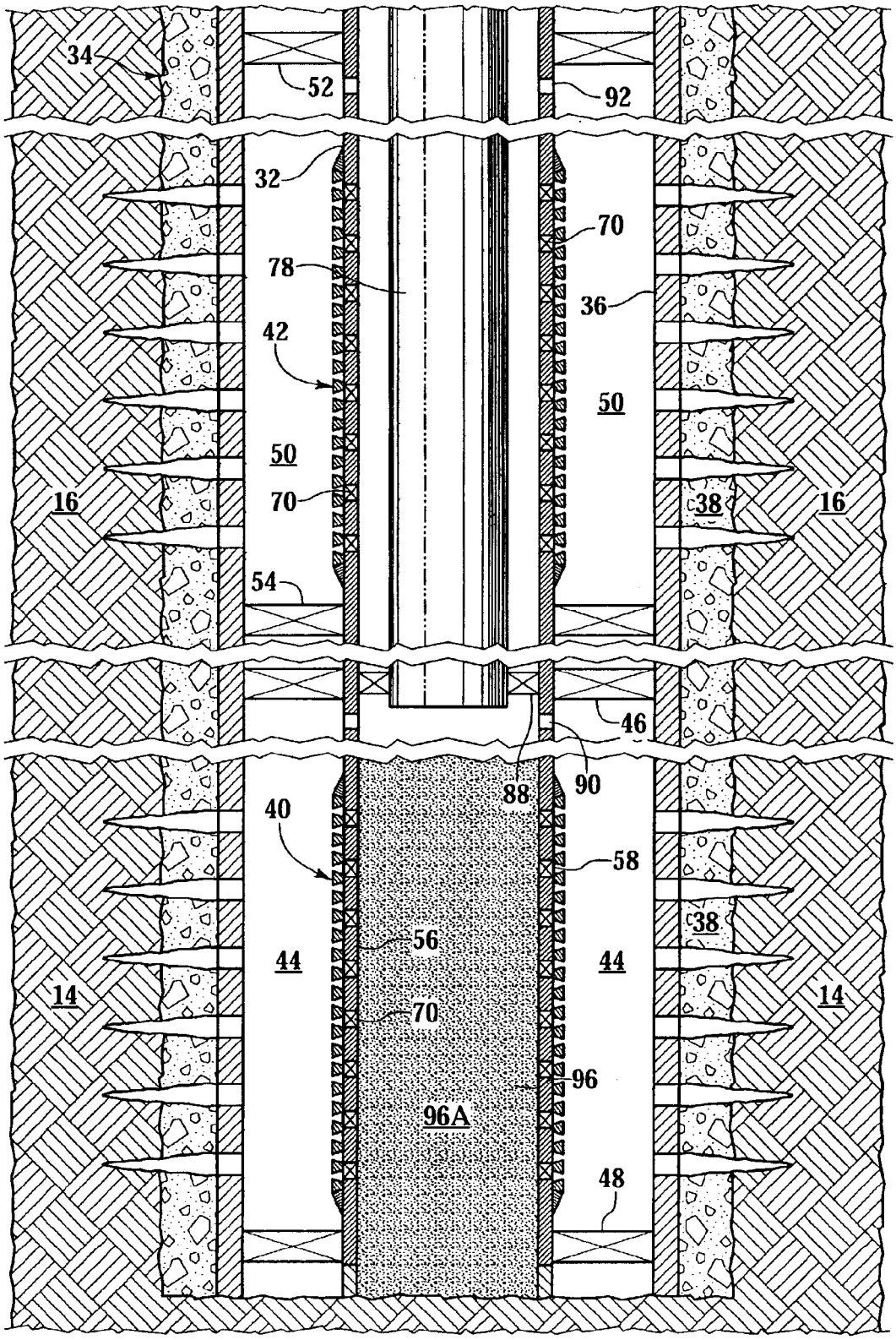
FIG. 11 is a half sectional view of a downhole production environment including a pair of sand control screen assemblies of the present invention during a first phase of a downhole treatment process.

Referring now to FIG. 11, when the treatment operation is a frac pack, the objective is to enhance the permeability of the treated formation by delivering a fluid slurry containing proppants 96 at a high flow rate and in a large volume above the fracture gradient of the formation such that fractures may be formed within the formation 14 and held open by proppants 96. In addition, a frac pack also has the objective of preventing the production of fines by packing production interval 44 with proppants 96.

In the initial phase of the treatment process of the present invention, the interior of sand control screen assemblies 40 is filled with a sand plug 96A. This is achieved by pumping treatment fluid downhole such as a relatively low viscosity oil or water based liquid including a high concentration of solid agents such as sand, gravel or proppants, that will fall out of the slurry relatively easily to form sand plug 96A. Sand plug 96A improves the ability of one-way valves 70 of sand control screen assembly 40 to prevent fluid flow from the interior to the exterior of sand control screen assembly 40. In addition, sand plug 96A prevents sand control screen assembly 40 from seeing the pressure spike that typically occurs at the end of a fracture operation. Accordingly, it is preferred that sand plug 96A extend past the near end of sand control screen assembly 40 as illustrated. It should be noted that this initial phase of the treatment process may not be necessary if sufficient solid agents fall out of the treatment fluids during the fracture or frac packing operations.

Figure 12:
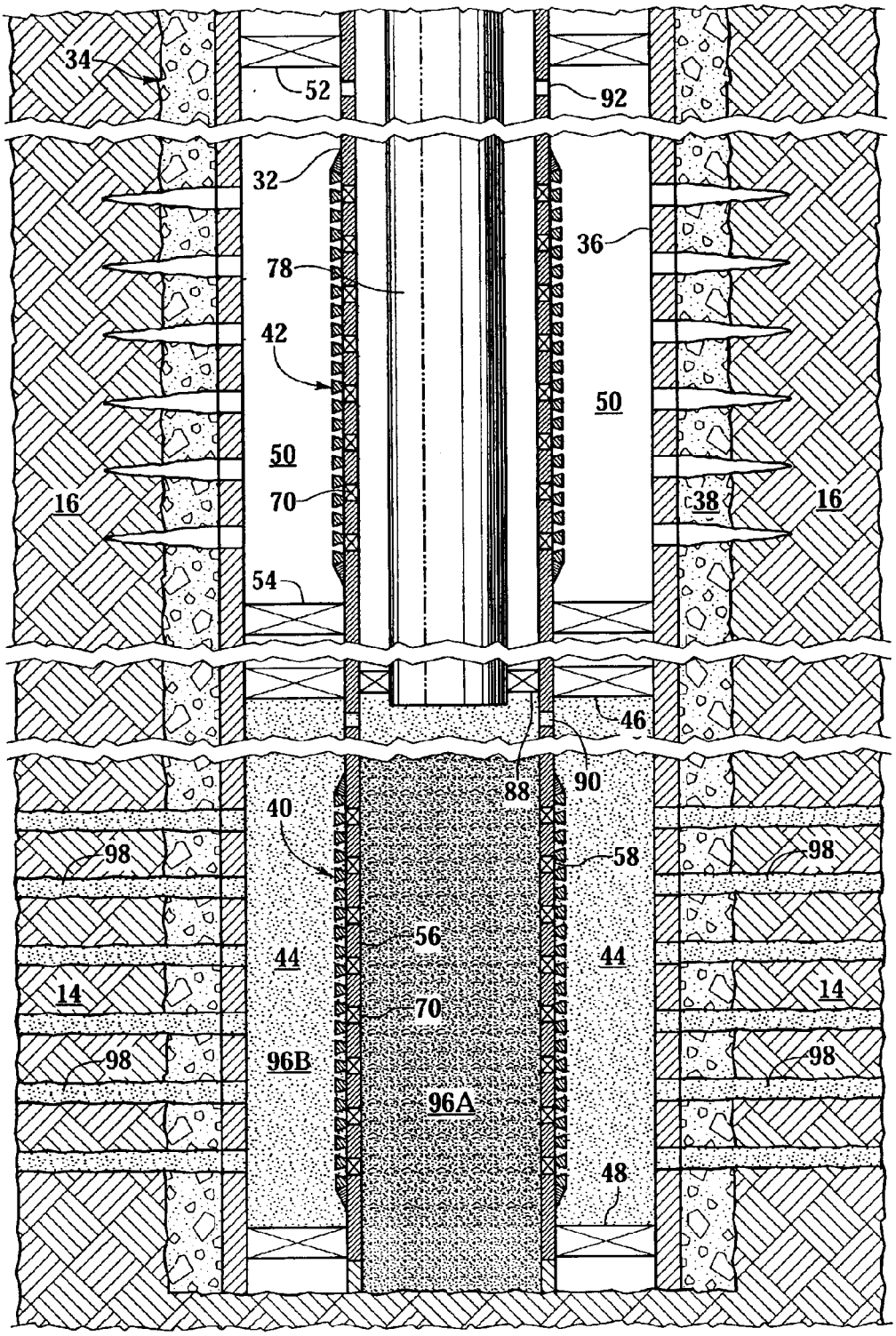
FIG. 12 is a half sectional view of a downhole production environment including a pair of sand control screen assemblies of the present invention during a second phase of a downhole treatment process.

Referring now to FIG. 12, once sand plug 96A is deposited in sand control screen assembly 40, the second phase of the treatment process may begin. The treatment fluid used during the second phase of the treatment process, which is the fracture operation, may be any appropriate fracturing fluid such as oil, water, an oil/water emulsion, gelled water or gelled oil based fracture fluid having a relatively high viscosity to enhance the fracturing process. This treatment fluid may or may not include solid agents such as sand, gravel or proppants but will usually have a lower concentration of solid agents than the treatment fluid of the first phase of the treatment process.

In the illustrated embodiment, the treatment fluid of the second phase of the treatment process includes a low concentration of proppants indicated by reference character 96B. The treatment fluid is pumped through service tool 78 and enters the near end of production interval 44 via cross-over ports 90. As the treatment fluid is being continuously pumped at a high flow rate and in a large volume above the fracture gradient of formation 14 and as no returns are being taken, the treatment fluid fractures formation 14 as indicated by reference character 98.

Figure 13:
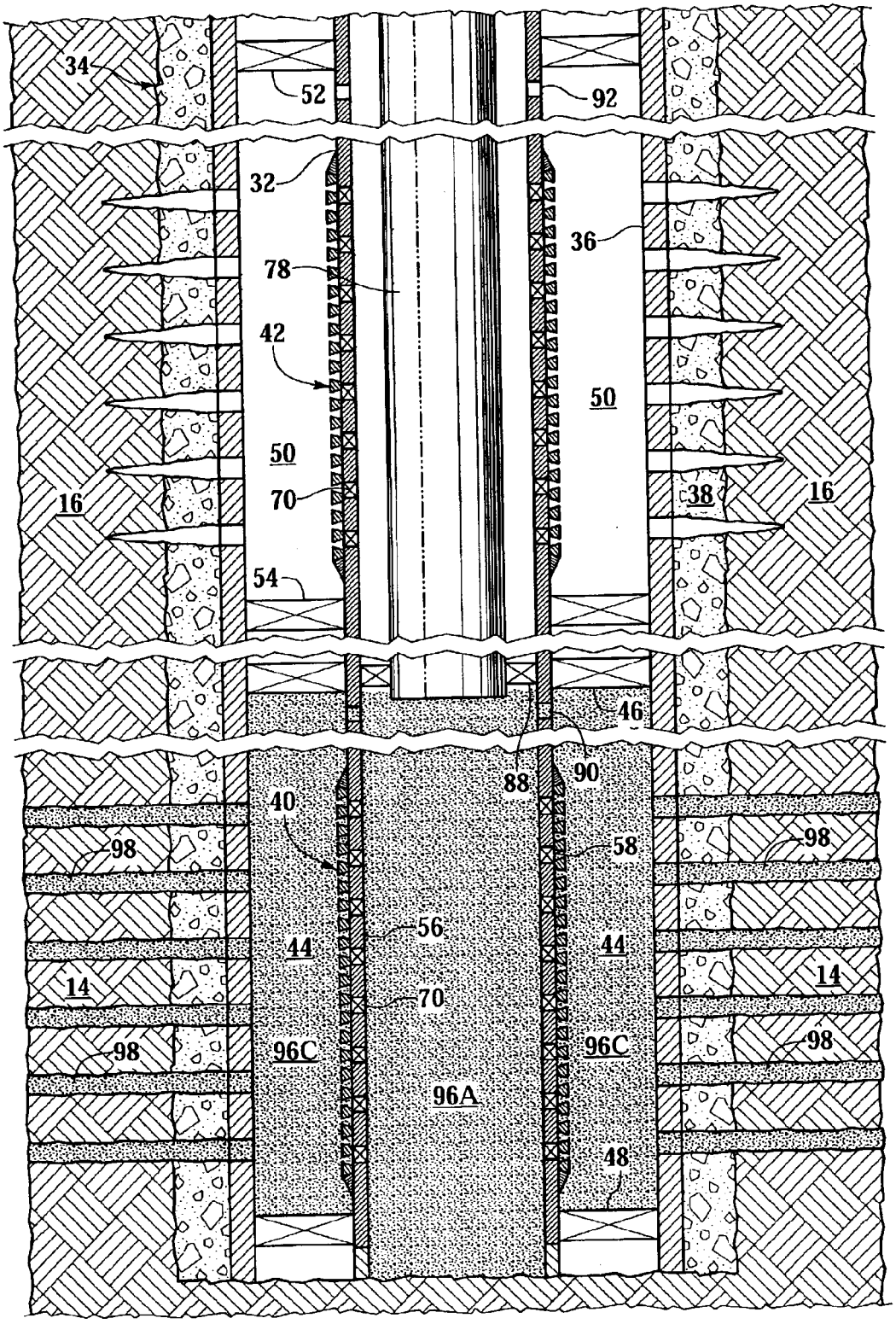
FIG. 13 is a half sectional view of a downhole production environment including a pair of sand control screen assemblies of the present invention during a third phase of a downhole treatment process.

Referring now to FIG. 13, prior to the point at which fractures 98 no longer propagate into formation 14, the third phase of the treatment process begins. The treatment fluid used during this phase may be any suitable fluid such as oil, water, an oil/water emulsion, gelled water or gelled oil based fluid including a suitable solid agent such as gravel, sand or proppants. In this phase of the treatment process, the solid agents travel into the newly created fractures to prop the fractures open and create a path of high permeability back to wellbore 34. In addition, the solid agents fill production interval 44 between sand control screen assembly 40 and casing 36 to form a gravel pack 96C therein which filters particulate matter out of production fluids once production begins. Upon completion of the frac packing of production interval 44, the valves associated with cross-over ports 90 are closed by conventional means.

Figure 14:
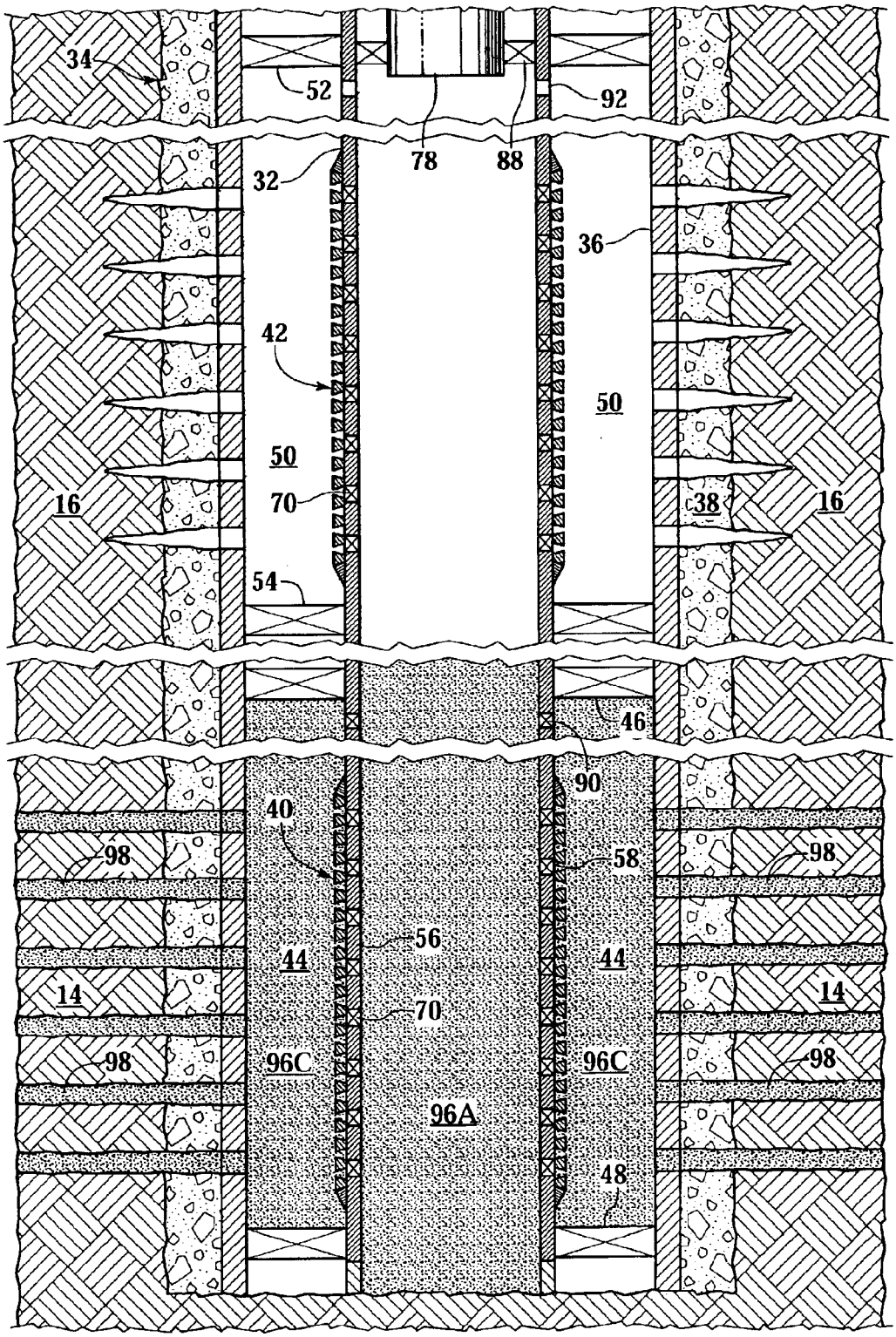
FIG. 14 is a half sectional view of a downhole production environment including a pair of sand control screen assemblies of the present invention during a fourth phase of a downhole treatment process.

Referring now to FIG. 14, following completion of the first frac packing operation, service tool 78 is operably repositioned to frac pack formation 16. As illustrated by the break between service tool 78 and sand control screen assembly 42, the service tool 78 may be several feet to several hundred feet uphole of sand control screen assembly 42. Once service tool 78 is positioned, a three-phase treatment process similar to that described above may begin.

Figure 15:
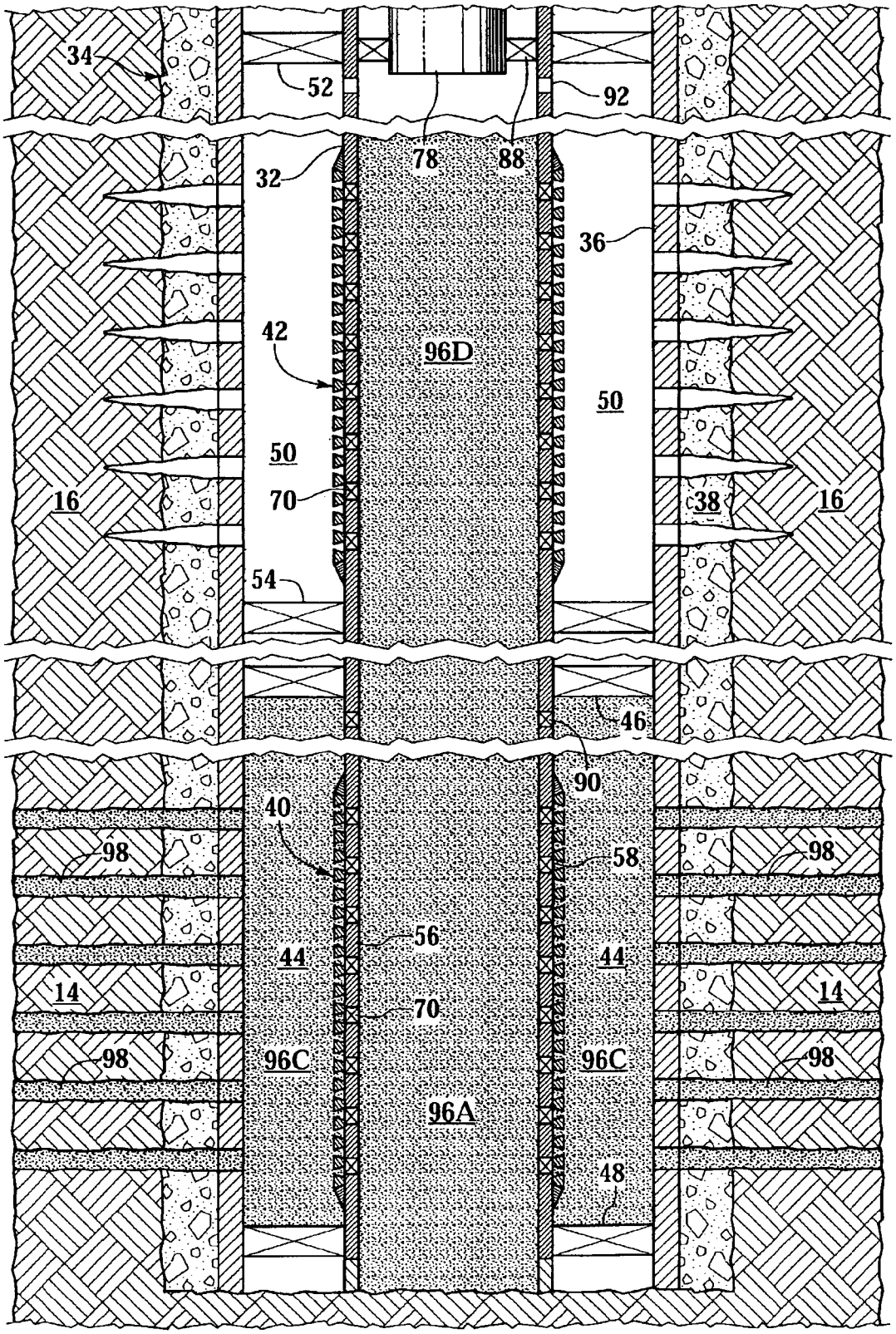
FIG. 15 is a half sectional view of a downhole production environment including a pair of sand control screen assemblies of the present invention during a fifth phase of a downhole treatment process.
Figure 16:
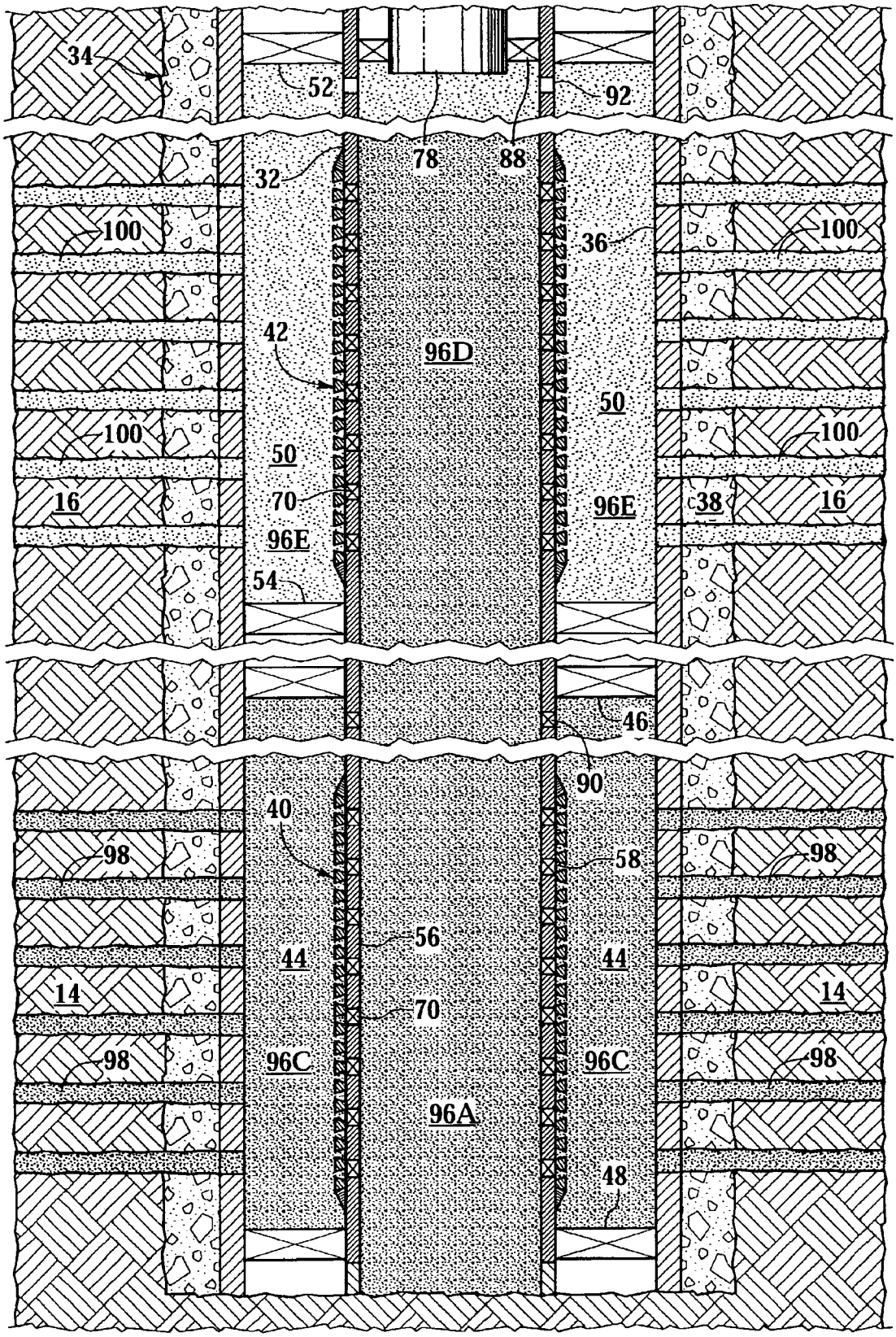
FIG. 16 is a half sectional view of a downhole production environment including a pair of sand control screen assemblies of the present invention during a sixth phase of a downhole treatment process.

Referring now to FIG. 15, the low viscosity treatment fluid with a high concentration of solid agents is pumped into sand control screen assembly 42 to form sand plug 96D. Fracture treatment fluid is then pumped through service tool 78, as best seen in FIG. 16. The treatment fluid enters the near end of production interval 50 via cross-over ports 92. In the illustrated embodiment the fracture fluid contains a low concentration of proppants indicated by 96E. As the fracture fluid is being delivered at a high flow rate and in a large volume above the fracture gradient of formation 16 and as no returns are being taken, the fracture fluids fracture formation 16 as indicated by fractures 100.

Figure 17:
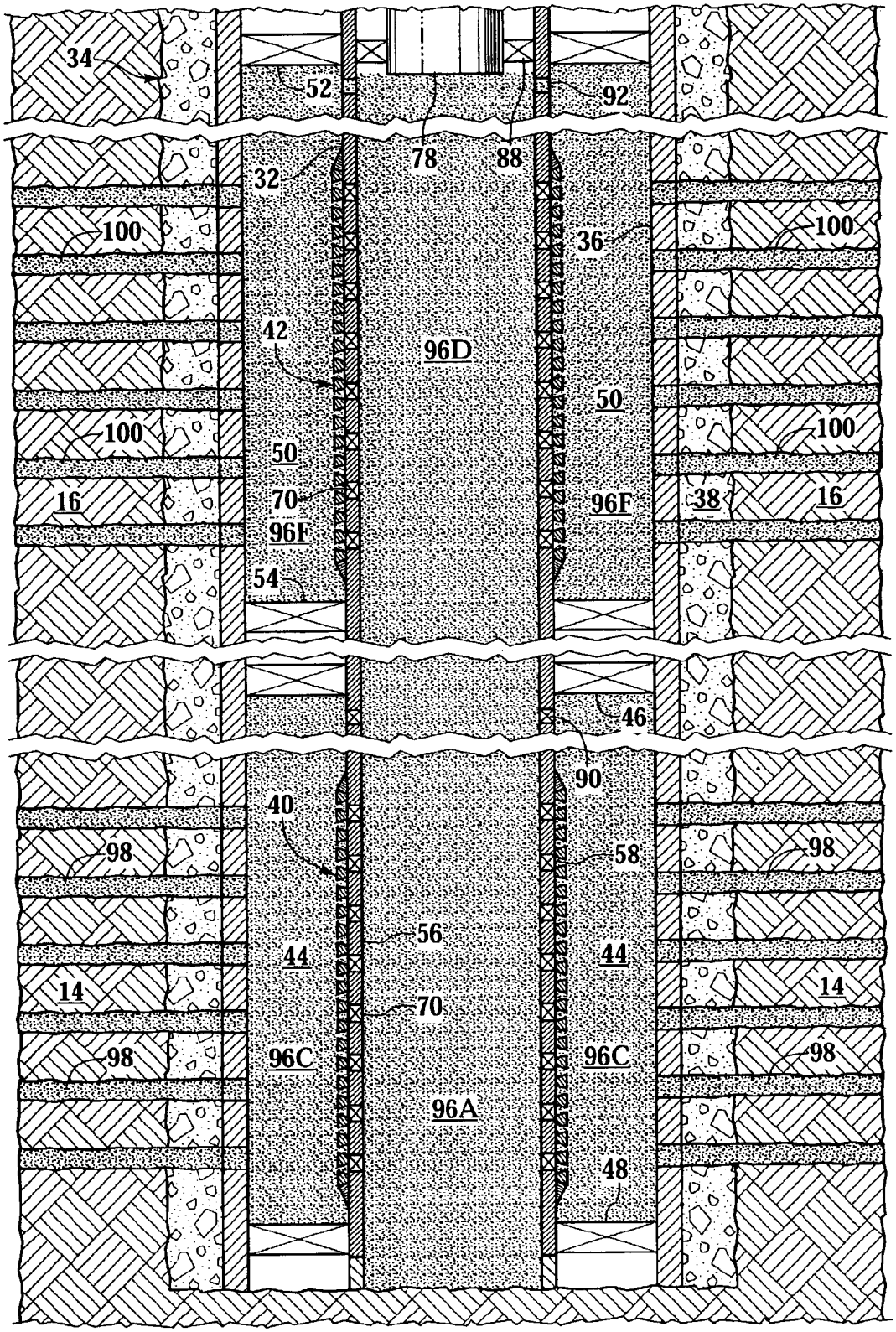
FIG. 17 is a half sectional view of a downhole production environment including a pair of sand control screen assemblies of the present invention during an seventh phase of a downhole treatment process.
Figure 18:
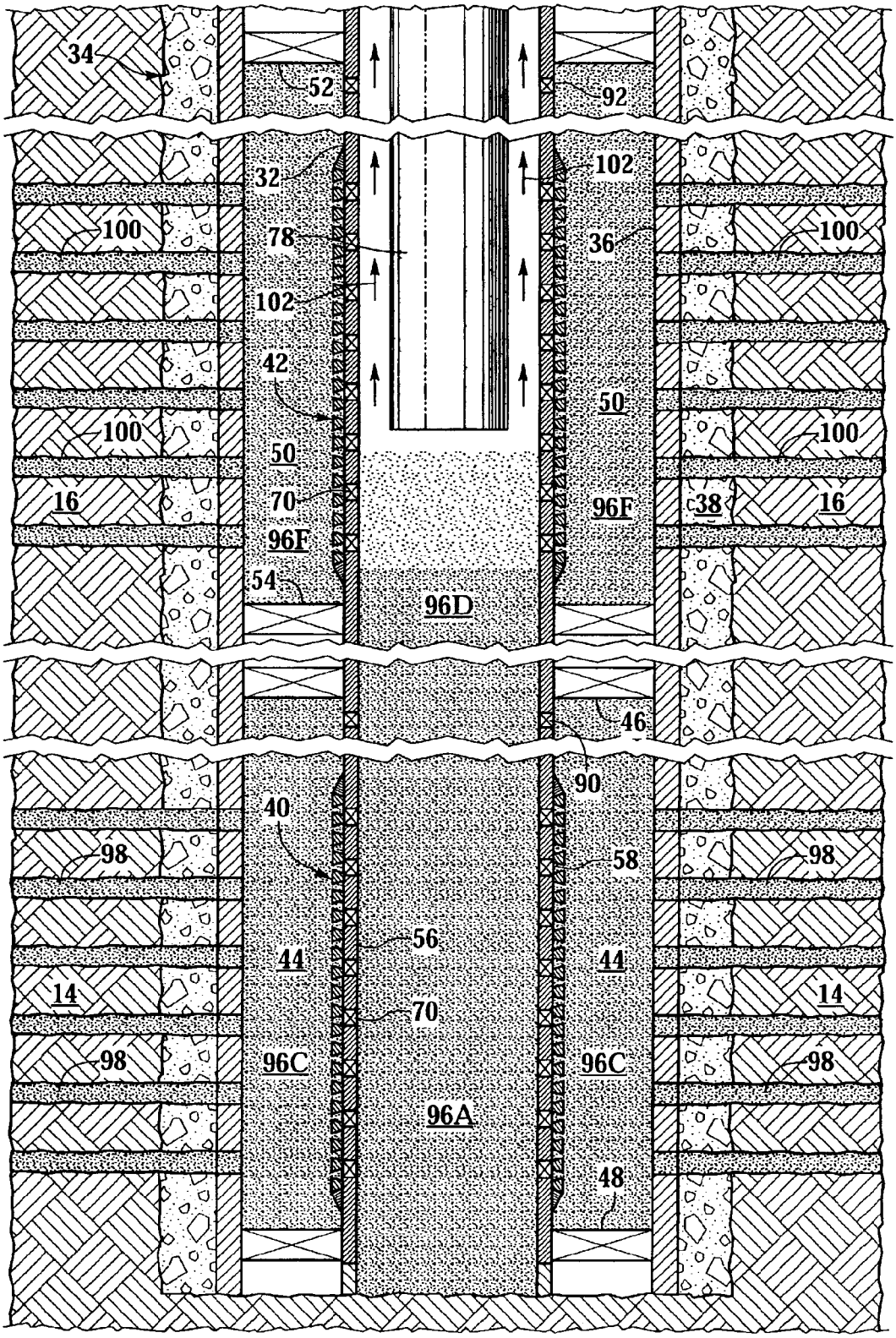
FIG. 18 is a half sectional view of a downhole production environment including a pair of sand control screen assemblies of the present invention during a eighth phase of a downhole treatment process.

Referring now to FIG. 17, toward the end of the fracture operation, the composition of the treatment fluid is changed to include a higher concentration of solid agents. These solid agents are used to prop fractures 100 in formation 16 and to form a gravel pack 96F in production interval 50 between sand control screen assembly 42 and casing 32. This three-phase treatment process can be repeated for any number of formations by repositioning service tool 78 sequentially uphole relative to each of the formations requiring treatment. Once all of the formations are treated and prior to beginning production, sand plugs 96A, 96D must be washed out of sand control screen assemblies 40, 42. As seen in FIG. 18, service tool 78 may be used to wash out the sand control screen assemblies 40, 42 and work string 32.

To wash out sand control screen assemblies 40, 42, liquid is delivered through service tool 78 to mix with the solid agents forming sand plugs 96A, 96D. The mixture is allowed to reverse out of work string 32 via the annulus between service tool 78 and work string 32 as indicated by arrows 105. This process of circulating the solid agents to the surface and lowering service tool 78 farther into work string 32 continues until substantially all the solid agents in work string 32 have been removed.

As explained above, different compositions of treatment fluids are used in the above described method during the different phases of the treatment process. Preferably, the first treatment fluid has a higher concentration of solid agents than the second treatment fluid. The first treatment fluid requires a higher concentration of solid agents as it is intended to place a sand plug in the sand control screen assemblies. The second treatment fluid does not require such solid agents as it is intended to fracture the formations. Additionally, the first treatment fluid preferably has a lower density and lower viscosity than the second treatment fluid. The lower density and lower viscosity in the first treatment fluid allow the solid agents to fall out of the slurry easily. The higher density and higher viscosity of the second treatment fluid allows the second treatment fluid to effectively fracture the formation.

The third treatment fluid preferably has a higher concentration of solid agents than the second treatment fluid. The third treatment fluid props the fractures and gravel packs the production intervals surrounding the sand control screen assemblies. Therefore, a higher concentration of solid agents is desirable in the third treatment fluid. Additionally, the third treatment fluid may have a lower density and lower viscosity than the second treatment fluid. The lower density and lower viscosity in the third treatment fluid allow the solid agents to fall out of the slurry more readily.

As should be apparent to those skilled in the art, the above described method allows the use of a relatively simple service tool 78 that allows for the treatment of multiple formations that are relatively close together. This is achieved by using sand control screen assemblies 40, 42 that include one-way valves 70 that prevent the flow of fluids from the interior to the exterior of sand control screen assemblies 40, 42. Accordingly, fewer tools are required between sand control screen assemblies 40, 42, thereby the distance between sand control screen assemblies 40, 42 may be reduced. This reduced distance and the simplicity of service tool 78 allow relatively narrow and relatively closely spaced formations to be treated according to the present invention.

Figure 19:
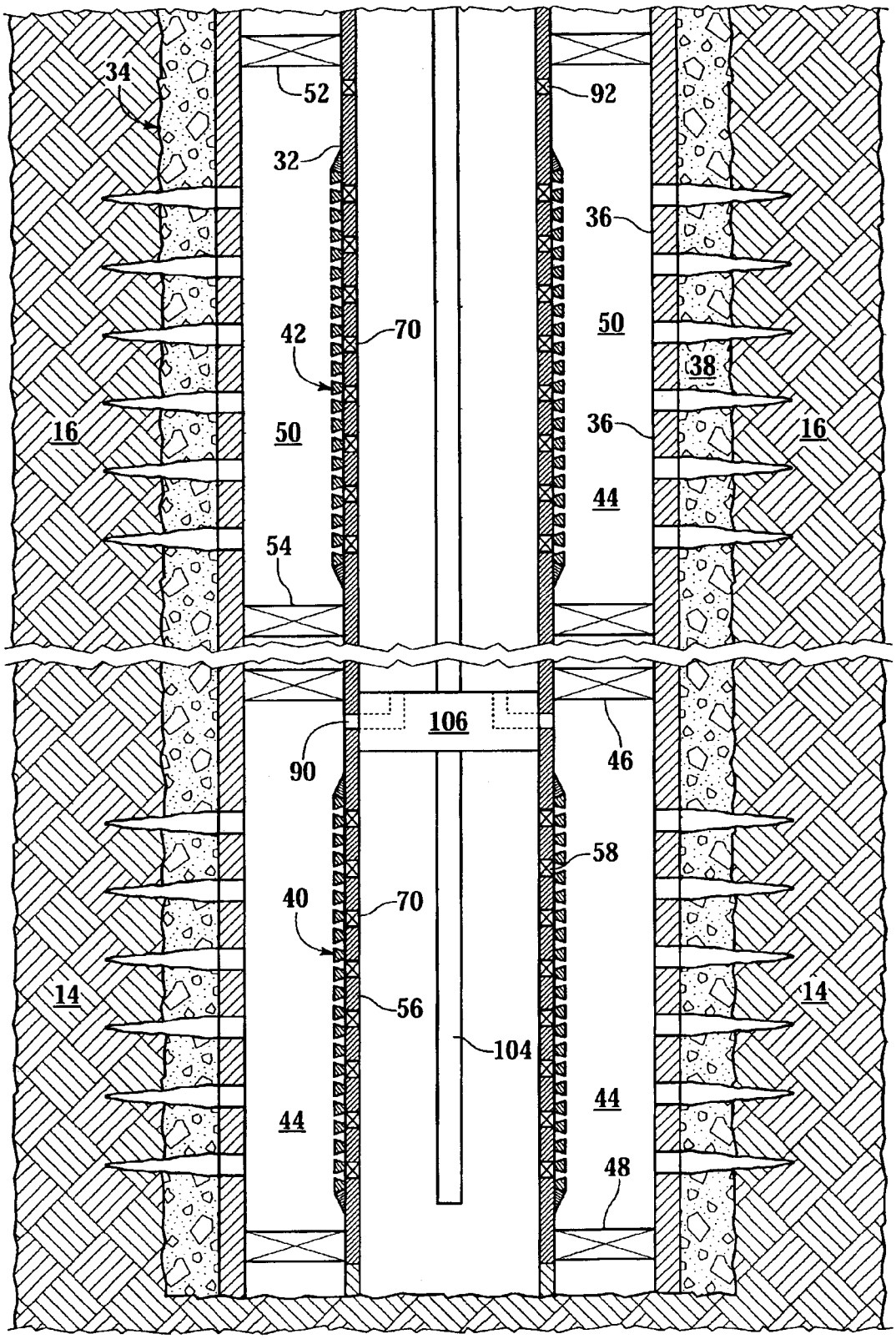
FIG. 19 is a half sectional view of a downhole production environment including a pair of sand control screen assemblies of the present invention before a downhole treatment process.

Referring now to FIG. 19, therein is schematically depicted an embodiment of the present invention that is used during a gravel packing treatment. As illustrated, sand control screen assembly 40 having one-way valves 70 is positioned within casing 36 and is adjacent to formation 14. Similarly, sand control screen assembly 42 having one-way valve 70 is positioned within casing 36 and is adjacent to formation 16. A wash pipe 104 extends through work string 32 traversing cross-over assembly 106. Cross-over assembly 106 is positioned within work string 32 adjacent to cross-over ports 90 that include valves therein as explained above.

Sand control screen assemblies 40, 42 each have a filter medium associated therewith that is designed to allow fluid to flow therethrough but prevent particulate matter of sufficient size from flowing therethrough. The exact design of the filter medium of sand control screen assemblies 40, 42 is not critical to the present invention as long as it is suitably designed for the characteristics of the formation fluids and the treatment fluids. One-way valves 70 of sand control screen assemblies 40, 42 may be of any suitable type so long as they prevent fluid flow from the interior to the exterior of sand control screens 40, 42.

To begin the gravel packing completion process, production interval 44 proximate formation 14 and production interval 50 proximate second formation 16 are isolated. Packer 46 seals the near end of production interval 44 and packer 48 seals the far end of production interval 44. Similarly, packer 52 seals the near end of production interval 50 and packer 54 seals the far end of production interval 50. Initially, as illustrated, the cross-over assembly 106 is located proximate to sand control screen assembly 40 and aligned with cross-over ports 90.

Figure 20:
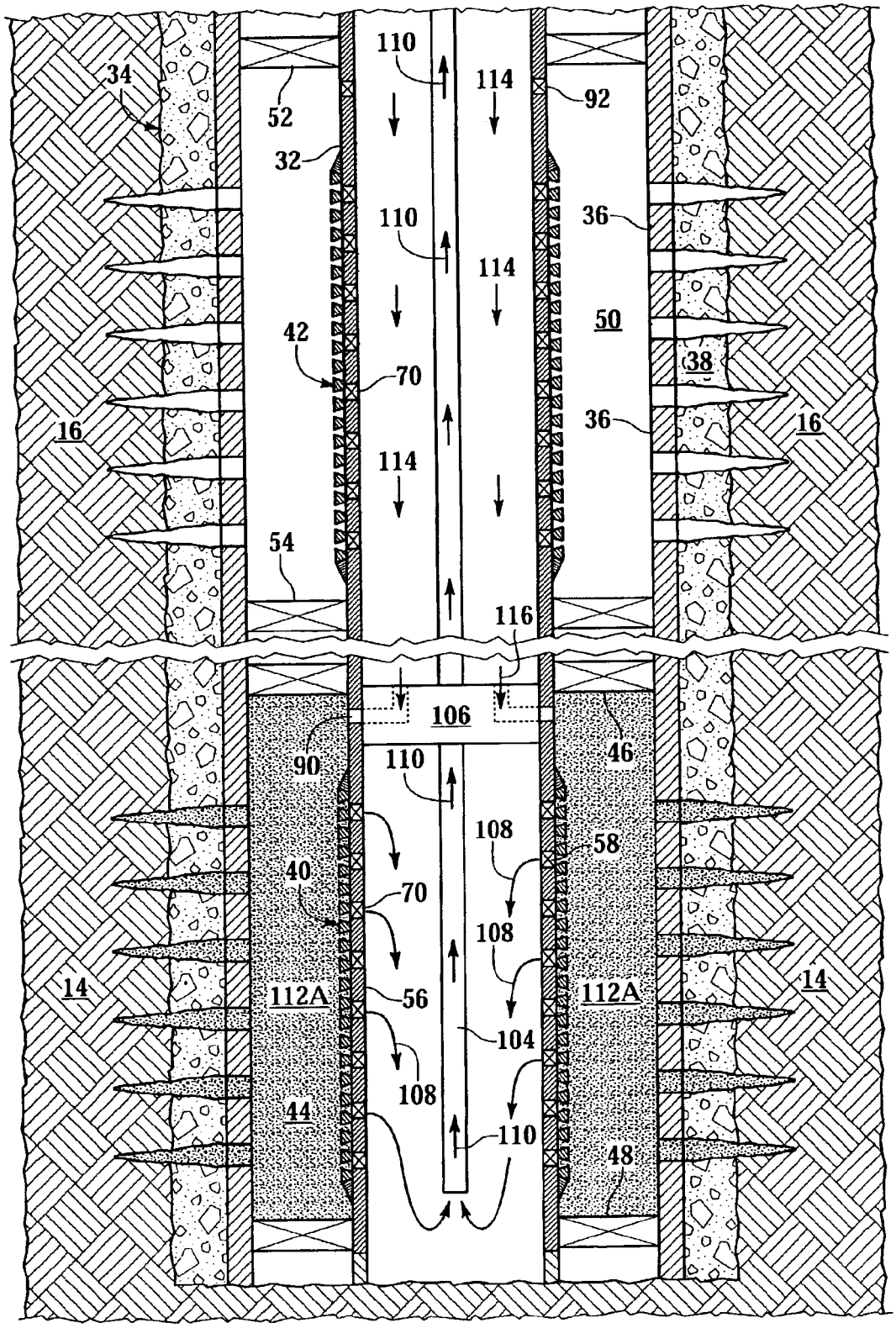
FIG. 20 is a half sectional view of a downhole production environment including a pair of sand control screen assemblies of the present invention during a first phase of a downhole treatment process.

Referring to FIG. 20, when the treatment operation is a gravel pack, the objective is to uniformly and completely fill production interval 44 between sand control screen assembly 40 and casing 36 with gravel. To help achieve this result, return fluid is taken through sand control screen assembly 40, indicated by arrows 108, and travels through wash pipe 104, as indicated by arrows 110, for return to the surface.

More specifically, a treatment fluid, in this case a fluid slurry containing gravel 112 is pumped downhole in work string 32, as indicated by arrows 114, and into production interval 44 via cross-over assembly 106, as indicated by arrows 116. As the fluid slurry containing gravel 112 travels to the far end of production interval 44, gravel 112 drops out of the slurry and builds up from formation 14, filling the perforations and production interval 44 around sand control screen assembly 40 forming gravel pack 112A. While some of the carrier fluid in the slurry may leak off into formation 14, the remainder of the carrier fluid passes through sand control screen assembly 40 through one-way valves 70, as indicated by arrows 108. The fluid flowing back through sand control screen assembly 40, as explained above, follows the paths indicated by arrows 110 back to the surface.

Figure 21:
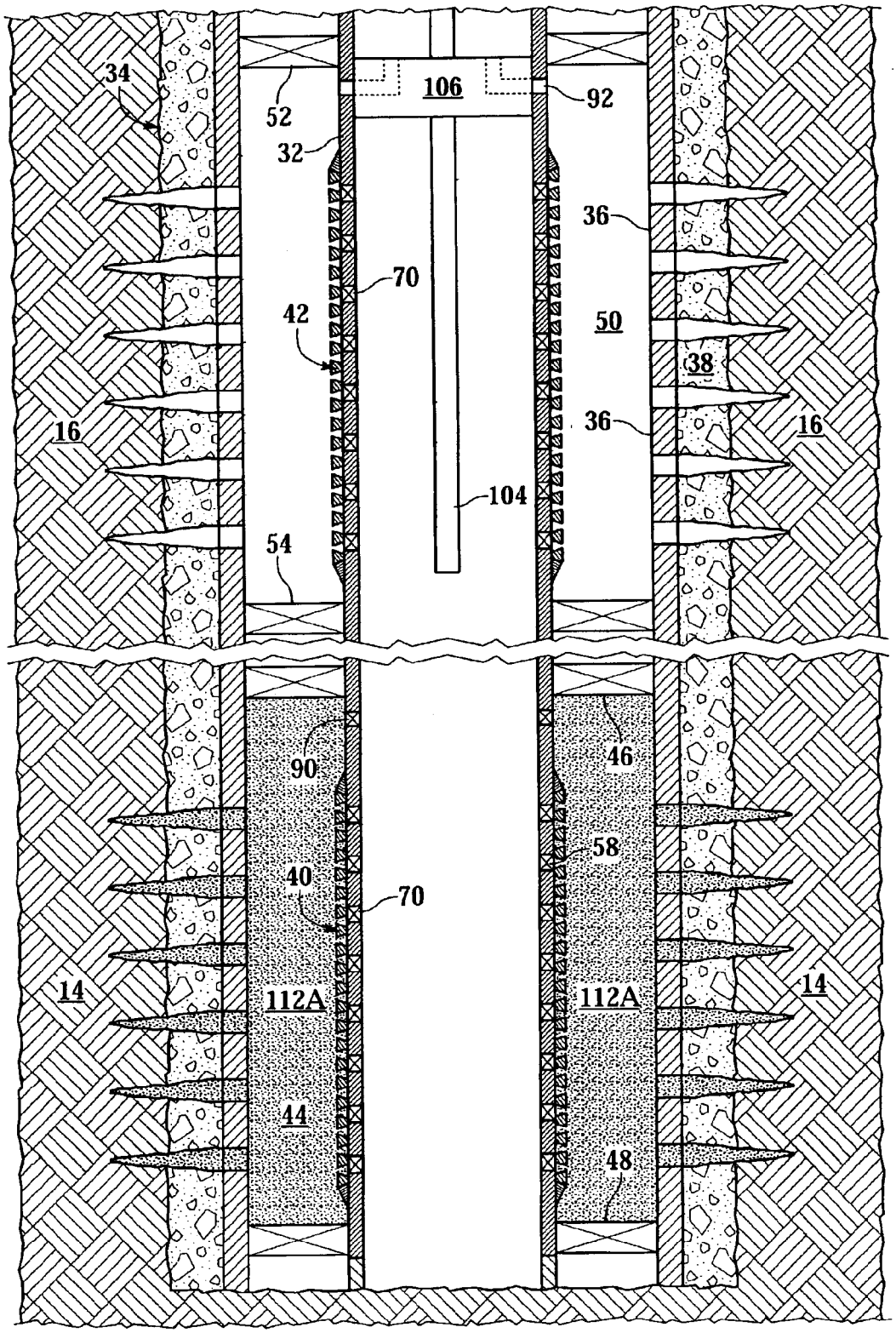
FIG. 21 is a half sectional view of a downhole production environment including a pair of sand control screen assemblies of the present invention during a second phase of a downhole treatment process.

After the gravel packing operation of production interval 44 is complete, cross-over assembly 106 and wash pipe 104 may be moved uphole such that other production intervals may be gravel packed, such as production interval 50, as best seen in FIG. 21. As the distance between formation 14 and formation 16 may be hundreds or even thousands of feet and as there may be any number of production intervals that require gravel packing, there may be a considerable amount of time between the gravel packing of production interval 44 and eventual production from formation 14.

It has been found that in conventional completions, considerable fluid loss may occur from the interior of sand control screen assembly 40 through gravel pack 112A and into formation 14. This fluid loss is not only costly but may also damage gravel pack 112A, formation 14 or both. Using the sand control screen assemblies of the present invention, however, prevents such fluid loss using a seal member, in this case, one-way valves 70, positioned within sand control screen assembly 40. Accordingly, one-way valves 70 not only save the expense associated with fluid loss but also protect gravel pack 112A and formation 14 from the damage caused by fluid loss.

Figure 22:
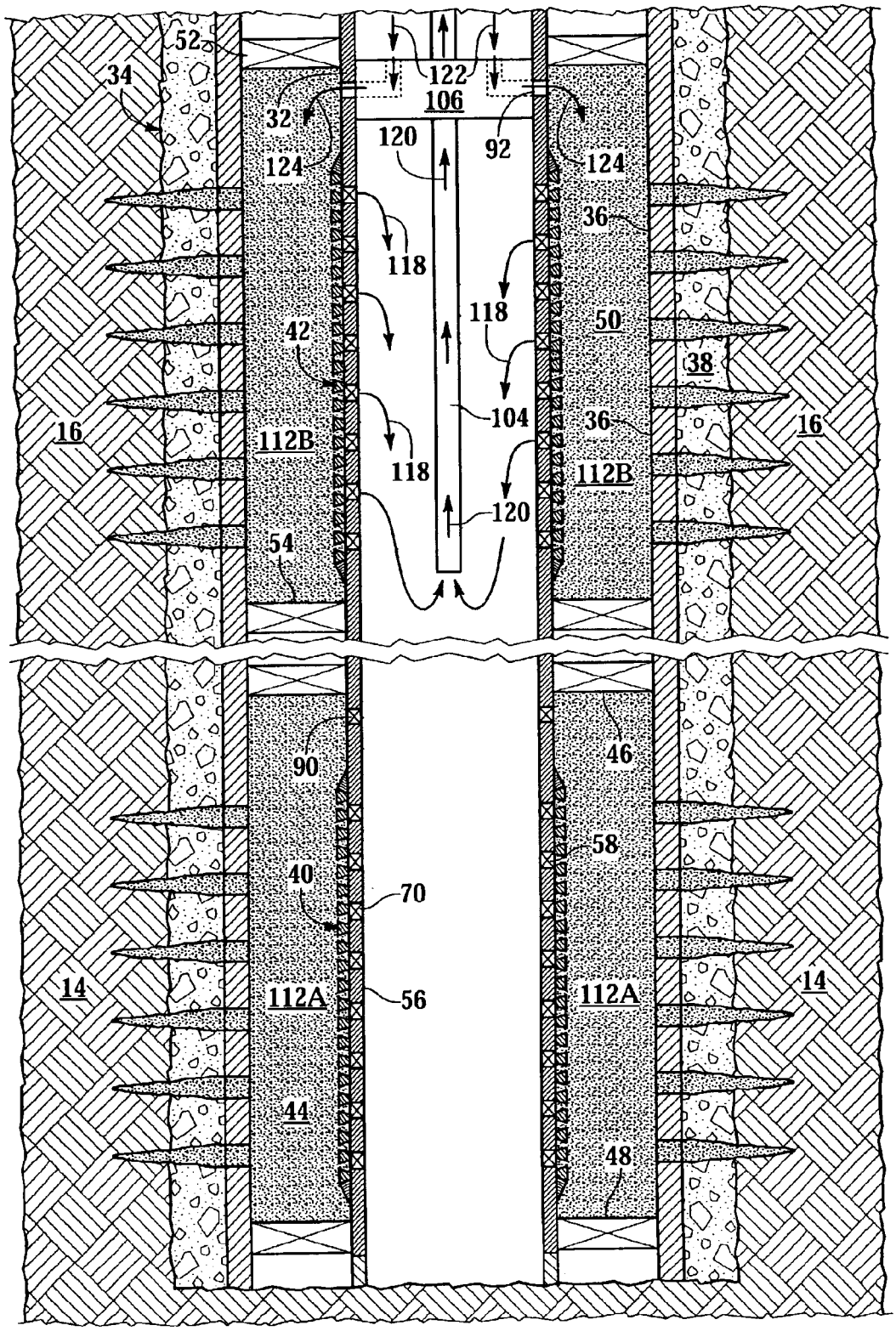
FIG. 22 is a half sectional view of a downhole production environment including a pair of sand control screen assemblies of the present invention during a third phase of a downhole treatment process.

Referring to FIG. 22, the process of gravel packing production interval 50 is depicted. Wash pipe 104 is now disposed within sand control screen assembly 42. Wash pipe 104 extends through cross-over assembly 106 such that return fluid passing through sand control screen assemblies 42, indicated by arrows 118, and travels through wash pipe 104, as indicated by arrows 120, for return to the surface.

The fluid slurry containing gravel 112 is pumped downhole through work string 32, as indicated by arrows 122, and into production interval 50 via cross-over assembly 106 and cross-over ports 92, as indicated by arrows 124. As the fluid slurry containing gravel 112 travels to the far end of production interval 50, the gravel 112 drops out of the slurry and builds up from formation 16, filling the perforations and production interval 50 around sand control screen assemblies 42 forming gravel pack 112B.

While some of the carrier fluid in the slurry may leak off into formation 16, the remainder of the carrier fluid passes through sand control screen assemblies 42 through one-way valves 70, as indicated by arrows 118. The fluid flowing back through sand control screen assembly 42, as explained above, follows the paths indicated by arrows 120 back to the surface. Once gravel pack 112B is complete, cross-over assembly 106 may again be repositioned uphole to gravel pack additional production intervals. As explained above, using sand control screen assembly 42 prevents fluid loss from the interior of sand control screen assembly 42 to formation 16 during such subsequent operations.

As should be apparent to those skilled in the art, even though FIGS. 10–22 present the treatment of multiple intervals of a wellbore in a vertical orientation with packers at the top and bottom of the production interval, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly positionable within a production interval comprising:

a base pipe having at least one opening that allows fluid flow therethrough;

a filter medium positioned about the exterior of at least a portion of the base pipe, the filter medium selectively allowing fluid flow therethrough and preventing particulate flow of a predetermined size therethrough; and a seal member operably associated with the base pipe that controls fluid flow through the opening of the base pipe, the seal member having a one-way valve configuration and a valve open configuration.

2. The sand control screen assembly as recited in claim 1 wherein the seal member in the one-way valve configuration prevents fluid loss from the interior to the exterior of the sand control screen assembly and allows fluid flow from the exterior to the interior of the sand control screen assembly when the differential pressure between the exterior and the interior of the sand control screen assembly exceeds a predetermined threshold.

3. The sand control screen assembly as recited in claim 1 wherein the seal member in the valve open configuration allows fluid flow from the interior to the exterior of the sand control screen assembly and from the exterior to the interior of the sand control screen assembly.

4. The sand control screen assembly as recited in claim 1 wherein the seal member further comprises a spring retainer, a biasing member and a shuttle valve.

5. The sand control screen assembly as recited in claim 4 wherein the spring retainer is in a first position relative to the base pipe when the seal member is in the one-way valve configuration such that the biasing member urges the shuttle valve into a sealing position.

6. The sand control screen assembly as recited in claim 5 wherein the spring retainer is in a second position relative to the base pipe when the seal member is in the valve open configuration such that the biasing member does not urge the shuttle valve into the sealing position.

7. The sand control screen assembly as recited in claim 6 wherein the spring retainer is releasably secured to the base pipe with at least one shear pin when the spring retainer is in the first position.

8. The sand control screen assembly as recited in claim 6 wherein the spring retainer is operated from the first position to the second position by the application of a tubing pressure within the base pipe.

9. The sand control screen assembly as recited in claim 6 wherein the spring retainer is secured to the base pipe with at least one collet finger when the spring retainer is in the second position.

10. The sand control screen assembly as recited in claim 4 wherein the shuttle valve has a sealing position and a non sealing position when the seal member is in the one-way valve configuration.

11. The sand control screen assembly as recited in claim 10 wherein the shuttle valve has a disabled position when the seal member is in the valve open configuration.

12. The sand control screen assembly as recited in claim 11 wherein the shuttle valve is secured to the base pipe with a keeper ring when the shuttle valve is in the disabled position.

13. The sand control screen assembly as recited in claim 11 wherein the shuttle valve is operated to the disabled position in response to a differential pressure above a predetermined threshold between the exterior and the interior of the sand control screen assembly.

14. The sand control screen assembly as recited in claim 11 wherein the shuttle valve is operated to the disabled position by mechanically shifting the shuttle valve relative to the base pipe.

15. A sand control screen assembly positionable within a production interval comprising:

a base pipe having at least one opening that allows fluid flow therethrough;

a filter medium positioned about the exterior of at least a portion of the base pipe, the filter medium selectively allowing fluid flow therethrough and preventing particulate flow of a predetermined size therethrough; and a seal member operably associated with the base pipe that controls fluid flow through the opening of the base pipe, the seal member having a one-way valve configuration and a valve open configuration, in the one-way valve configuration, the seal member preventing fluid loss from the interior to the exterior of the sand control screen assembly and allows fluid flow from the exterior to the interior of the sand control screen assembly when the differential pressure between the exterior and the interior of the sand control screen assembly exceeds a predetermined threshold, in the valve open configuration, the seal member allowing fluid flow from the interior to the exterior of the sand control screen assembly and from the exterior to the interior of the sand control screen assembly.

16. The sand control screen assembly as recited in claim 15 wherein the seal member further comprises a spring retainer, a biasing member and a shuttle valve.

17. The sand control screen assembly as recited in claim 16 wherein the spring retainer is in a first position relative to the base pipe when the seal member is in the one-way valve configuration such that the biasing member urges the shuttle valve into a sealing position.

18. The sand control screen assembly as recited in claim 17 wherein the spring retainer is in a second position relative to the base pipe when the seal member is in the valve open configuration such that the biasing member does not urge the shuttle valve into the sealing position.

19. The sand control screen assembly as recited in claim 18 wherein the spring retainer is releasably secured to the base pipe with at least one shear pin when the spring retainer is in the first position.

20. The sand control screen assembly as recited in claim 18 wherein the spring retainer is operated from the first position to the second position by the application of a tubing pressure within the base pipe.

21. The sand control screen assembly as recited in claim 18 wherein the spring retainer is secured to the base pipe with at least one collet finger when the spring retainer is in the second position.

22. The sand control screen assembly as recited in claim 16 wherein the shuttle valve has a sealing position and a non sealing position when the seal member is in the one-way valve configuration.

23. The sand control screen assembly as recited in claim 22 wherein the shuttle valve has a disabled position when the seal member is in the valve open configuration.

24. The sand control screen assembly as recited in claim 23 wherein the shuttle valve is secured to the base pipe with a keeper ring when the shuttle valve is in the disabled position.

25. The sand control screen assembly as recited in claim 23 wherein the shuttle valve is operated to the disabled position in response to a differential pressure above a predetermined threshold between the exterior and the interior of the sand control screen assembly.

26. The sand control screen assembly as recited in claim 23 wherein the shuttle valve is operated to the disabled position by mechanically shifting the shuttle valve relative to the base pipe.

27. A sand control screen assembly comprising:

a tubular member having at least one fluid passageway in a sidewall section thereof;

a filter medium positioned exteriorly around the tubular member defining a first annular region with the tubular member;

a housing positioned exteriorly around the tubular member defining a second annular region with the tubular member; and a seal member positioned within the second annulus, the seal member having a one-way valve configuration and a valve open configuration, the seal member including a spring retainer, a biasing member and a shuttle valve, the spring retainer having a first position relative to the tubular member when the seal member is in the one-way valve configuration such that the biasing member urges the shuttle valve into a sealing position, the spring retainer having a second position relative to the tubular member when the seal member is in the valve open configuration such that the biasing member does not urge the shuttle valve into the sealing position.

28. The sand control screen assembly as recited in claim 27 wherein the seal member in the one-way valve configuration prevents fluid loss from the interior to the exterior of the sand control screen assembly and allows fluid flow from the exterior to the interior of the sand control screen assembly when the differential pressure between the exterior and the interior of the sand control screen assembly exceeds a predetermined threshold.

29. The sand control screen assembly as recited in claim 27 wherein the seal member in the valve open configuration allows fluid flow from the interior to the exterior of the sand control screen assembly and from the exterior to the interior of the sand control screen assembly.

30. The sand control screen assembly as recited in claim 27 wherein the spring retainer is releasably secured to the base pipe with at least one shear pin when the spring retainer is in the first position.

31. The sand control screen assembly as recited in claim 27 wherein the spring retainer is operated from the first position to the second position by the application of a tubing pressure within the base pipe.

32. The sand control screen assembly as recited in claim 27 wherein the spring retainer is secured to the base pipe with at least one collet finger when the spring retainer is in the second position.

33. The sand control screen assembly as recited in claim 27 wherein the shuttle valve has a sealing position and a non sealing position when the seal member is in the one-way valve configuration.

34. The sand control screen assembly as recited in claim 33 wherein the shuttle valve has a disabled position when the seal member is in the valve open configuration.

35. The sand control screen assembly as recited in claim 34 wherein the shuttle valve is secured to the base pipe with a keeper ring when the shuttle valve is in the disabled position.

36. The sand control screen assembly as recited in claim 34 wherein the shuttle valve is operated to the disabled position in response to a differential pressure above a predetermined threshold between the exterior and the interior of the sand control screen assembly.

37. The sand control screen assembly as recited in claim 34 wherein the shuttle valve is operated to the disabled position by mechanically shifting the shuttle valve relative to the base pipe.

38. A downhole treatment method comprising the steps of:

locating a sand control screen assembly within a production interval of a wellbore;

pumping a treatment fluid into the production interval;

allowing fluid returns to enter the interior of the sand control screen assembly with a seal member of the sand control screen assembly in a one-way valve configuration;

preventing fluid loss from the interior to the exterior of the sand control screen assembly with the seal member of the sand control screen assembly in the one-way valve configuration;

operating the seal member from the one-way valve configuration to a valve open configuration; and allowing production fluids to enter the interior of the sand control screen assembly.

39. The method as recited in claim 38 wherein the step of allowing fluid returns to enter the interior of the sand control screen assembly when a seal member of the sand control screen assembly is in a one-way valve configuration further comprises operating a shuttle valve from a sealing position to a non sealing position when the differential pressure between the exterior and the interior of the sand control screen assembly exceeds a predetermined threshold.

40. The method as recited in claim 38 wherein the step of allowing fluid returns to enter the interior of the sand control screen assembly when a seal member of the sand control screen assembly is in a one-way valve configuration further comprises overcoming the bias force of a biasing member.

41. The method as recited in claim 38 wherein the step of operating the seal member from the one-way valve configuration to a valve open configuration further comprises applying a tubing pressure above a predetermined threshold within a base pipe of the sand control screen assembly.

42. The method as recited in claim 38 wherein the step of operating the seal member from the one-way valve configuration to a valve open configuration further comprises shifting a spring retainer from a first position relative to a base pipe of the sand control screen assembly to a second position relative to the base pipe.

43. The method as recited in claim 38 wherein the step of operating the seal member from the one-way valve configuration to a valve open configuration further comprises operating a shuttle valve to a disabled position.

44. The method as recited in claim 43 wherein the step of operating a shuttle valve to a disabled position further comprises applying a differential pressure above a predetermined threshold between the exterior and the interior of the sand control screen assembly.

45. The method as recited in claim 43 wherein the step of operating a shuttle valve to a disabled position further comprises mechanically shifting the shuttle valve relative to a base pipe of the sand control screen assembly.

* * * * *